US006774755B2

(12) United States Patent
Nakata et al.

(10) Patent No.: US 6,774,755 B2
(45) Date of Patent: Aug. 10, 2004

(54) CHOKE COIL

(75) Inventors: Toshiyuki Nakata, Matsusaka (JP); Koji Nakashima, Matsusaka (JP); Katsunori Omura, Tsu (JP); Kiyoshi Takagi, Matsusaka (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 09/091,805

(22) PCT Filed: Oct. 23, 1997

(86) PCT No.: PCT/JP97/03833

§ 371 (c)(1),
(2), (4) Date: Dec. 10, 1998

(87) PCT Pub. No.: WO98/18143

PCT Pub. Date: Apr. 30, 1998

(65) Prior Publication Data

US 2002/0067237 A1 Jun. 6, 2002

(30) Foreign Application Priority Data

Oct. 24, 1996 (JP) ..... 8-281963
Oct. 24, 1996 (JP) ..... 8-281965

(51) Int. Cl.[7] ..... H01F 27/02
(52) U.S. Cl. ..... 336/83; 336/200
(58) Field of Search ..... 336/83, 192, 198, 336/200, 223, 232, 212

(56) References Cited

U.S. PATENT DOCUMENTS 4,352,080 A * 9/1982 Mitsui et al. ..... 336/83
4,507,640 A 3/1985 Rich, III et al.
5,175,525 A * 12/1992 Smith ..... 336/83

FOREIGN PATENT DOCUMENTS

DE 2401574 7/1975
DE 3817890 A1 12/1988
JP 07-320961 * 12/1995

* cited by examiner

*Primary Examiner*—Tuyen T. Nguyen
(74) *Attorney, Agent, or Firm*—Rossi & Associates

(57) ABSTRACT

The present invention relates to a choke coil utilized in a variety of electronic products both for industrial use and consumer use, and aims to provide a choke coil that is thinner in size, accommodates a larger current, provides better efficiency in assembly and higher reliability. The choke coil of the present invention comprises a closing magnetic core having a center magnetic leg, an outer magnetic leg 36 and a common magnetic yoke. A coreless coil winds a plate-type wire around the center magnetic leg of the closing magnetic core to form itself, and is mounted to the closing magnetic core. At least one terminal coupled to an inner turn of the coreless coil out of terminals coupled to both ends of the plate-type wire of the coreless coil is led out from a notch provided on one side of the common magnetic yoke of the closing magnetic core.

21 Claims, 25 Drawing Sheets

FIG. 17A
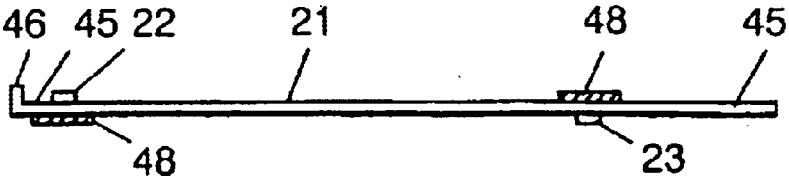
FIG. 17B
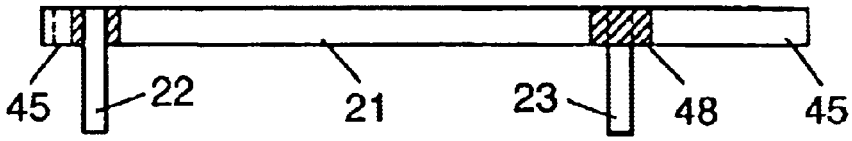
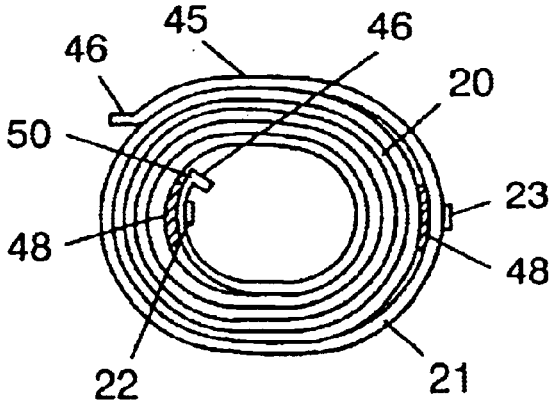
FIG. 18
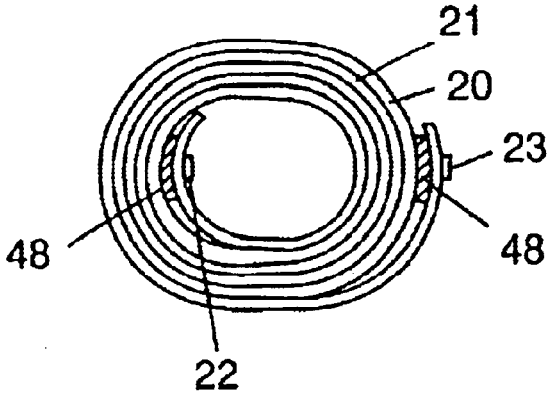
FIG. 19

FIG. 26A
FIG. 26B
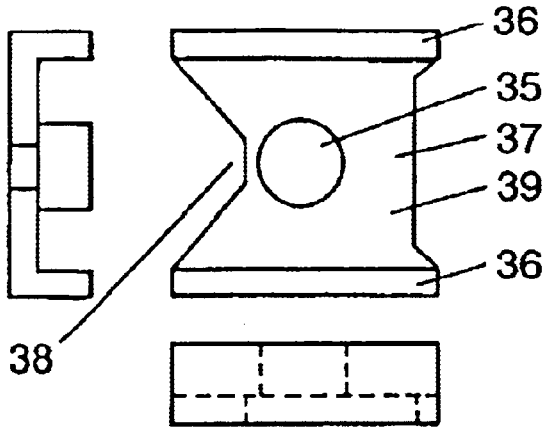
FIG. 26C
FIG. 27A
FIG. 27B
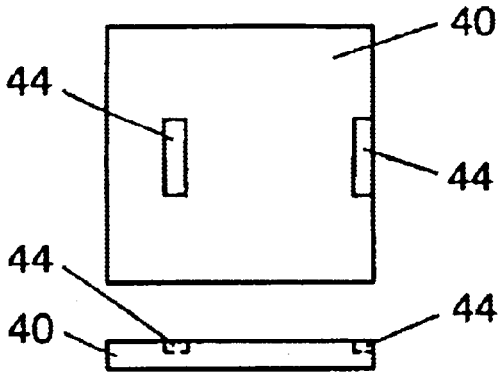
FIG. 28A
FIG. 28B
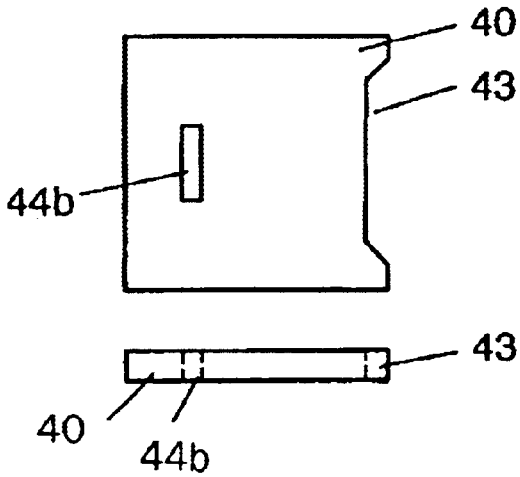

CHOKE COIL

FIELD OF THE INVENTION

The present invention relates to a choke coil utilized in electronic products both for consumer and industrial uses.

BACKGROUND OF THE INVENTION

Thanks to the development of various electronic devices, electronic products have become smaller and thinner in size, consume power, and have better performance. And yet, the market's demand for the better products still continues. In order to meet this demand, a power supply section, particularly in a switching power supply, has struggled with the following three major demands: 1. accommodating a higher switching frequency, 2. employing a higher density of parts mounting, particularly when utilizing surface mounting techniques, 3. accommodating a large current responsive to a higher performance of semiconductor, etc. Accordingly, a demand has arisen for a choke coil, one of the major parts of the switching power supply, having a smaller loss, that accommodates a larger current, and is smaller and thinner for use with surface mounting techniques.

A conventional thin-type choke coil well known in the market is illustrated in FIGS. 47 through 51. FIG. 47 is an exploded perspective view, FIG. 48 is a perspective view depicting the coil incorporated with a closing magnetic core. FIG. 49 is a perspective view depicting a complete product. FIG. 50 is a cross section, and FIG. 51 is a top view depicting the coil from which one magnetic core is removed.

The following elements are illustrated in the above Figs.: flat type wire 1 covered by an insulated material, coreless coil 2, an inner turn 3 of the coreless coil 2, an outer turn 4 of the coreless coil 2, a terminal 5 of the inner turn 3, a terminal 6 of the outer turn 4, a center magnetic leg 7, an outer magnetic leg 8, a common magnetic yoke 9, a closing magnetic core 10 of magnetic field, an insulating paper 11, a window height 12 of the closing magnetic core 10. The structure of the conventional thin-type choke coil is as follows: The coreless coil 2 is formed by coiling the flat type wire 1. The inner terminal 5 and the outer terminal 6 are coupled with an inner turn 3 and outer turn 4 of the coreless coil 2 respectively by e.g., soldering. The coreless coil 2 and the insulating paper 11 are disposed around the center magnetic leg 7 of the closing magnetic core 10.

In the above structure, however, the inner terminal 5 coupled with the inside turn 3 of the coreless coil 2 is led out from a clearance between the coreless coil 2 and the common magnetic yoke 9 of the closing magnetic core 10, thus a thickness of the inner terminal 5 is added to the window height 12 of the closing magnetic core 10, whereby a dead space is produced in the window height direction. As a result, a space factor lowers and the choke coil cannot be further slimmed.

In addition, since the inner terminal 5 is led out from the clearance between the coreless coil 2 and the common magnetic yoke 9, a sectional area of the inner terminal 5 cannot be enlarged. Thus, the choke coil cannot accommodate a larger current.

The present invention aims to provide a thinner choke coil by lowering the height, and a choke coil which can accommodate a larger current as well.

SUMMARY OF THE INVENTION

In order to address the above problems, the choke coil according to the present invention comprises the following elements:

(a) a closing magnetic core having a center magnetic leg, an outer magnetic leg and a common magnetic yoke, (b) a coreless coil made of a coiled plate-type-wire comprising a flat-type-wire or foil-type-wire, having terminals on both ends of the plate-type-wire.

The coreless coil is disposed around the center magnetic leg of the closing magnetic core, and at least an inner terminal of the terminals is led out from a notch or an opening provided on the common magnetic yoke of the closing magnetic core. Thus the thickness of the inner terminal of the coreless coil does not influence the window height of the closing magnetic core. As a result, no dead space is allowed in the window height direction, the space factor increases, and the window height of the closing magnetic core can be lowered, whereby a thinner choke coil is realized. At the same time, the thickness as well as the cross area of the inner terminal can be increased so that the choke coil can accommodate a larger current.

BRIEF DESCRIPTION OF THE DRAWINGS

FIG. 17A and FIG. 17B are a top view and a front view depicting the coreless coil before it is coiled.

FIG. 18 is a top view of the coreless coil depicted in FIG. 17.

FIG. 19 is a top view of another coreless coil.

FIG. 26A through FIG. 26C are a top view, side view and front view depicting the E-shape magnetic core.

FIG. 27A and FIG. 27B are a bottom view and a front view depicting the I-shape magnetic core.

FIG. 28A and FIG. 28B are a bottom view and a front view depicting another I-shape magnetic core.

DESCRIPTION OF THE PREFERRED EXEMPLARY EMBODIMENT

Figure 1:
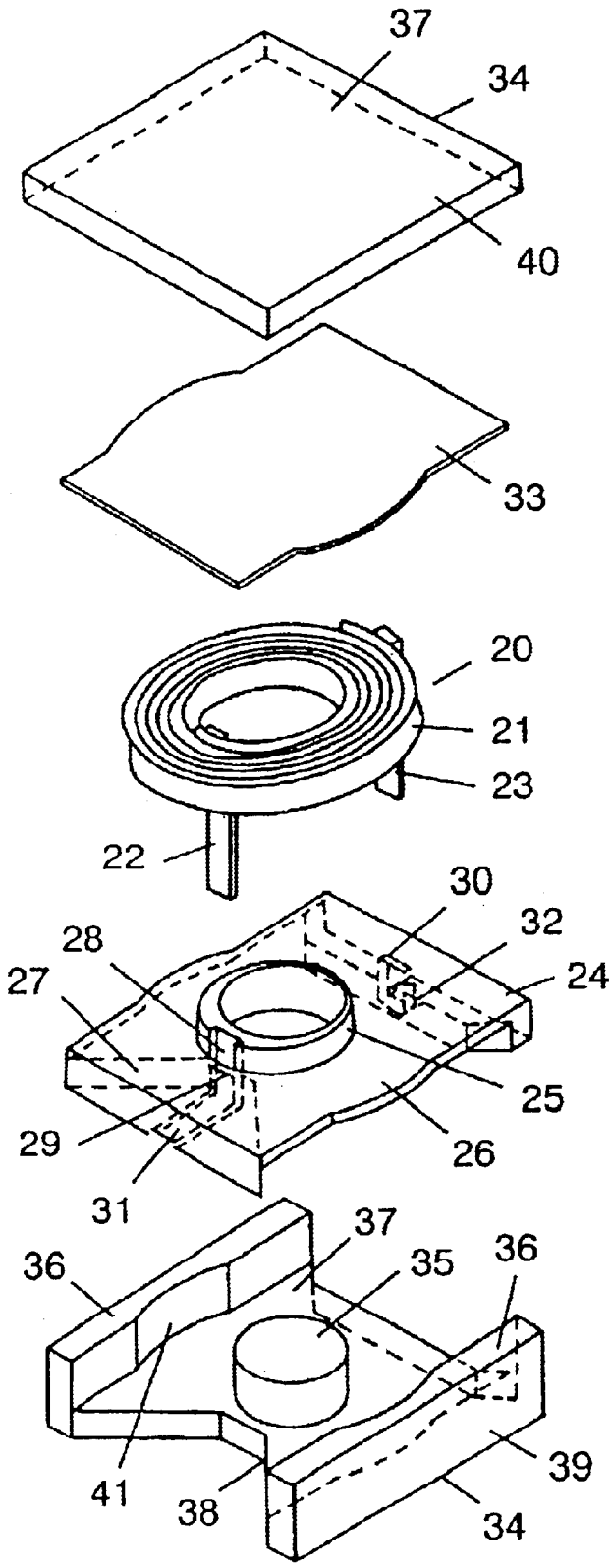
FIG. 1 is an exploded perspective view of the choke coil in the first exemplary embodiment according to the present invention.

The present invention is further detailed by referring to the attached drawings.

Embodiment 1

The first exemplary embodiment of the present invention is described by referring to FIGS. 1–5. A coreless coil 20 comprises a coiled plate-type wire 21 made of flat type wire or foil type wire. More specifically, a self welding flat-type-wire coils itself and is heated to soften the self welding layer, thereby welding the layers with each other and forming the coreless coil 20.

The thickness of the wall of the cylinder 25 of the terminal base 24 varies from a minimum thickness to a maximum thickness. At the point of maximum thickness, the wall of the cylinder 25 has a vertical groove 28 which guides the terminal 22 of the coreless coil 20. A terminal hole 29 through which the terminal 22 extends is punched on the base plate 26 at the lower end of the vertical groove 28 and on the triangular protrusion 27. Another terminal hole 30 is punched on the base plate 26 to which the terminal 23 coupled with the outer end corresponds. Beneath the bottom face of the triangular protrusion 27, a terminal groove 31 connected to the terminal hole 29 is provided. Also beneath the base plate, a terminal groove 32 connected to the terminal hole 30 is provided. After assembling the coreless coil 20 with the terminal base 24, the protruded terminals 22 and 23 are bent, and then fit into the terminal grooves 31 and 32 so that the terminals 22 and 23 can be led out to the sides from the triangular protrusion 27 in the terminal base 24 and the corresponding end face of the base plate 26. In other words, when this type of terminal base 24 is used, the terminals 22 and 23 are led out to the opposite directions independently, i.e., led out at an angle of 180° difference with each other, and whereby the choke coil is suitably constructed for surface mounting.

The cylinder 25 of the terminal base 24 has a thickness deviation at a part, i.e., this part is thicker than other part, corresponding to the terminal 22 of the coreless coil 20, and has a vertical groove 28 which guides the terminal 22 engaged with the corresponding thicker part. A terminal hole 29 through which the terminal 22 extends is punched on the base plate 26 at the lower end of the vertical groove 28 and on the triangular protrusion 27. Another terminal hole 30 is punched on the base plate 26 to which the terminal 23 coupled with the outer end corresponds. Beneath the bottom face of the triangular protrusion 27, a terminal groove 31 connected to the terminal hole 29 is provided. Also beneath the base plate, a terminal groove 32 connected to the terminal hole 30 is provided. After assembling the coreless coil 20 with the terminal base 24, the protruded terminals 22 and 23 are bent, and then fit into the terminal grooves 31 and 32 so that the terminals 22 and 23 can be led out to the sides from the triangular protrusion 27 in the terminal base 24 and the corresponding end face of the base plate 26. In other words, when this type of terminal base 24 is used, the terminals 22 and 23 are led out to the opposite directions independently, i.e., led out at an angle of 180° difference with each other, and whereby the choke coil is suitably constructed for surface mounting.

A closing magnetic core 34 is incorporated with the assembled product of the coreless coil 20 and the terminal base 24. The closing magnetic core 34 is formed by E-shape magnetic core 39 and I-shape magnetic core 40, which are both made of a sintered body of manganese ferrite. The magnetic core 39 of the closing magnetic core 34 comprises a center magnetic leg 35, outer magnetic legs 36 on both sides, and a common magnetic yoke 37. On the common magnetic yoke 37 of the E-shape magnetic core 39, a notch 38 is provided in which the triangular protrusion 27 of the terminal base 24 can be fit. A cavity 41 is provided at inside center of the outer magnetic leg 36 of the E-shape magnetic core as a guide along an outer shape of the coreless coil 20, whereby the dimension of the choke coil can be further reduced.

Figure 2:
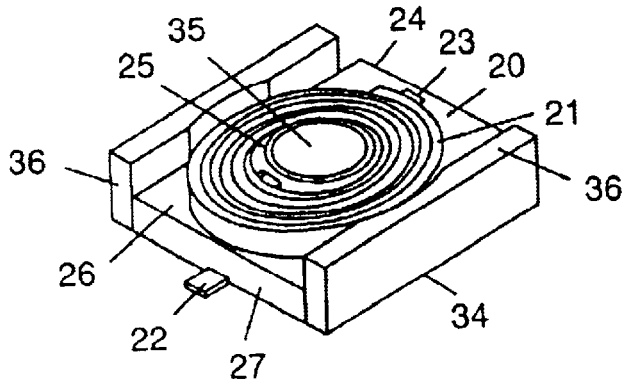
FIG. 2 is a perspective view depicting the coreless coil mounted to the terminal base illustrated in FIG. 1.

The above structure is manufactured by performing the following operations: assemble the terminal base 24 with the coreless coil 20, bend the terminals 22 and 23 along the terminal grooves 31 and 32, and fit the terminals into the grooves, then incorporate the E-shape magnetic core 39 having a cylindrical center magnetic leg 35 with the terminal base 24 from its bottom face, and fit the triangular protrusion 27 into the notch 38 so that the both elements are positioned, whereby a structure illustrated in FIG. 2 is completed. Then, incorporate insulating sheet 33 with the—structure of FIG. 2, and further incorporate the I-shape magnetic core 40, thereby completing the choke coil illustrated in FIG. 3.

In this assembly, when the center magnetic leg 35 is lower than the outer magnetic leg 36 of the E-shape magnetic core 39 on both sides, the choke coil is able to have a magnetic gap 42 above the center magnetic leg 35, thereby improving the current superimpose characteristics of the choke coil without increasing leakage flux from the closing magnetic core 34.

The insulating sheet 33 is made of polyester film, polyhenylenesulfide film, or aramid paper, and is inserted into the magnetic gap between the center magnetic leg 35 of the E-shape magnetic core 39 and I-shape magnetic core 40.

In the above structure, since the terminal base 24, the triangular protrusion 27 and the terminals 22, 23 are placed or led out by utilizing the notch 38 of the common magnetic yoke 37, the thickness of the terminals 22, 23 does not affect the window height direction of the closing magnetic core 34. Thus the terminals 22, 23 can be enlarged both in thickness and sectional area, whereby the choke coil can accommodate a large current. Further, the coreless coil 20 is mounted on the face where the center magnetic core 35 is adjacent to the common magnetic yoke 37 of the closing magnetic core 34, with insulating layers such as the base plate 26 and the cylinder 25 between the coreless coil 20 and the face. Accordingly, the coreless coil 20, the terminals 22 and 23 are prevented from being damaged during assembly, and as a result, the choke coil with the higher efficiency in assembly as well as the higher reliability can be realized.

Figure 6:
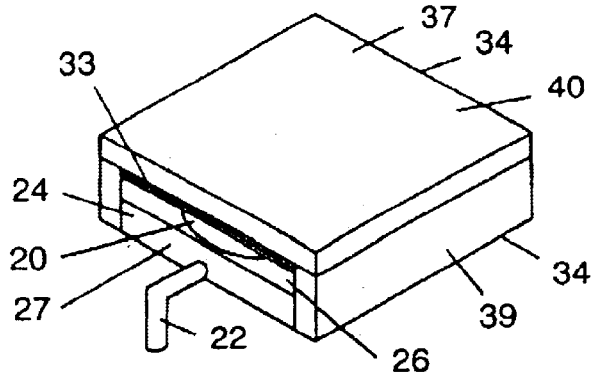
FIG. 6 is a perspective view depicting an example of a pin terminal.

In the above exemplary embodiment, the plate-type terminal is employed as the terminals 22, 23 coupled to both the ends of the coreless coil 20, however, a pin-type terminal as illustrated in FIG. 6 can be also employed, whereby the choke coil can be mounted in a multi-layer printed circuit board.

Figure 7:
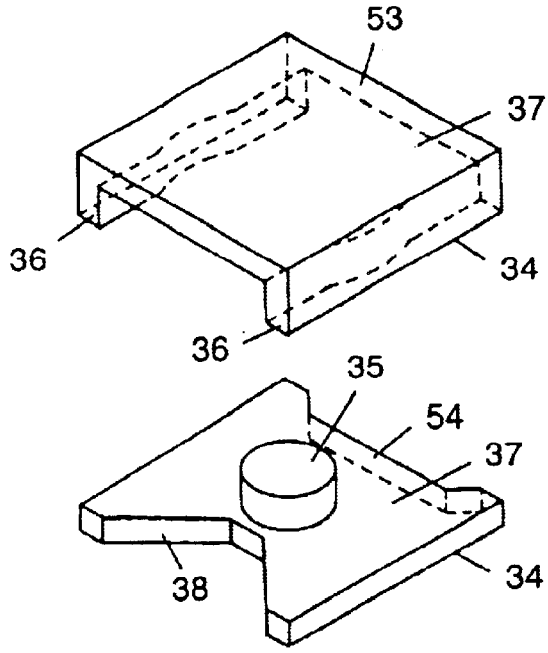
FIG. 7 is a perspective view depicting an example of TU-shape magnetic core.
Figure 8:
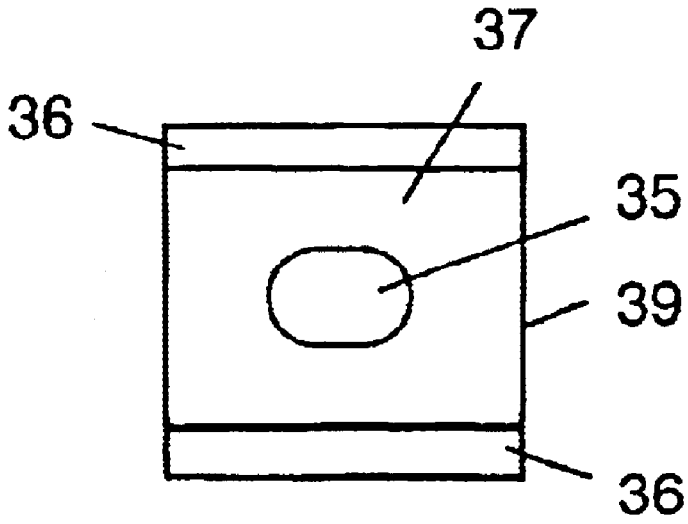
FIG. 8 is a top view depicting a modification of E-shape magnetic core.
Figure 9:
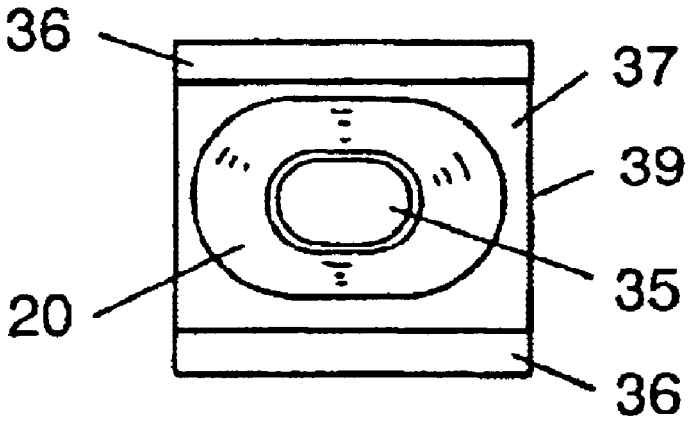
FIG. 9 is a top view depicting the coreless coil mounted around the E-shape magnetic core.
Figure 10:
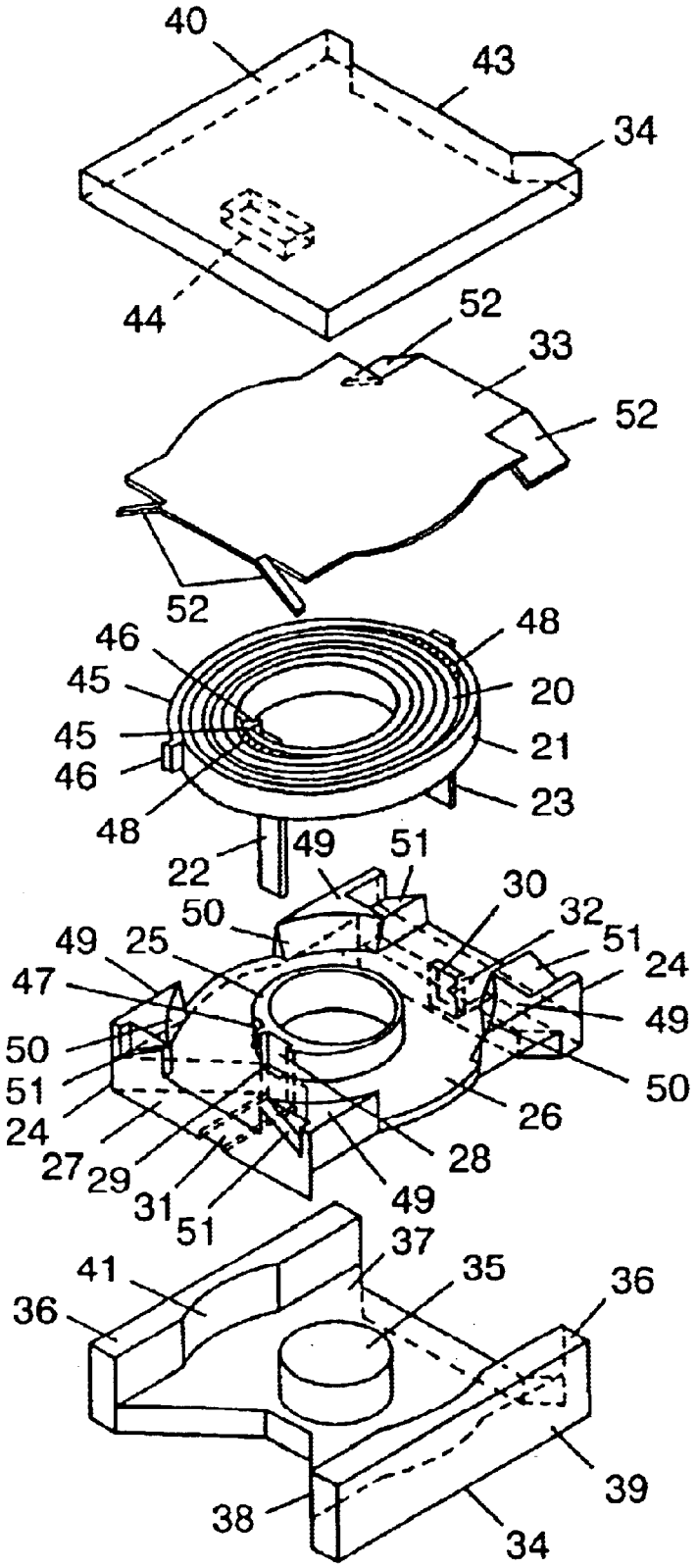
FIG. 10 is an exploded perspective view depicting the choke coil utilized in the second exemplary embodiment of the present invention.

The E and I-shapes (EI-shape) magnetic cores are employed in the closing magnetic core 34 in the above embodiment, however, the TU-shape or EE-shape magnetic core as shown in FIG. 7 can be employed instead of the EI-shape. Although the cross sectional view of the center magnetic leg 35 of the closing magnetic core 34 shows a circle in the above embodiment, it can be an ellipse or oval so that the window width of the closing magnetic core 34 can be broadened with regard to the sectional area of the center magnetic leg 35 as shown in FIGS. 8 and 9.

Figure 3A:
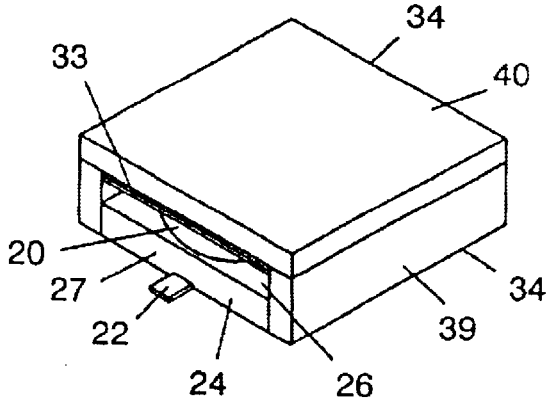
FIG. 3A is a perspective view of a completed product shown in FIG. 2.
Figure 3B:
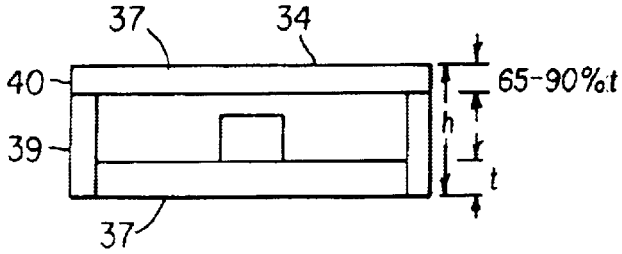
FIG. 3B is a side view of the closing magnetic core of the choke coil according to the present invention.
Figure 4:
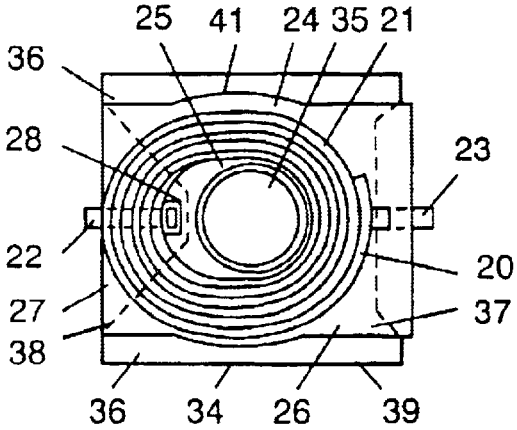
FIG. 4 is a top view depicting the assembled elements illustrated in FIG. 3 including the coreless coil, the terminal base and E-shape magnetic core.
Figure 5:
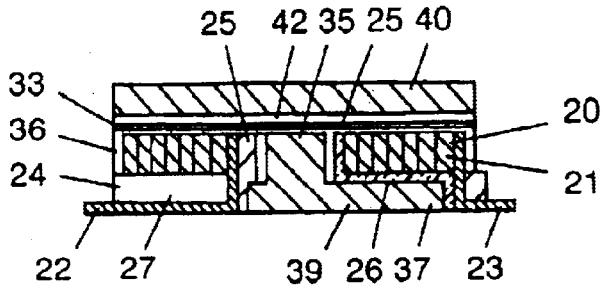
FIG. 5 is a cross section of the completed product shown in FIG. 4.

In accordance with a preferred embodiment as shown in FIG. 3B, when the notch 38 or a through hole 56 is provided on a first, i.e. top or bottom, common magnetic yoke 37 and not provided on a second common magnetic yoke 37, a thickness of the second common magnetic yoke 37 can be 65–90% that of a thickness "t" of the first common magnetic yoke 37 without affecting the characteristics of the choke coil. As a result, a weight of the ferrite core can be reduced, and a height "h" of the choke coil can be lowered.

Embodiment 2

In accordance with a preferred embodiment as shown in FIG. 3B, when the notch 38 or a through hole 56 (FIG. 29) is provided on a first common magnetic yoke 37 and not provided on a second common magnetic yoke 37, a thickness of the second common magnetic yoke 37 can be 65–90% that of a thickness "t" of the first common magnetic yoke 37 without affecting the characteristics of the choke coil. As a result, a weight of the ferrite core can be reduced, and a height "h" of the choke coil can be lowered.

The portions which retain the terminals 22 and 23, therefore, should be avoided being both ends of the coil, and an extension part 45 is provided instead, whereby adhesion by heating is increased, and as a result, the coil is prevented from losing its coiled shape.

In addition, a bent portion 46 is provided on both the ends in a radial direction, i.e., the bent portion 46 at the inner end protrudes inward, and another bent portion 46 at the outer end protrudes outward. This structure can prevent insulation between the layers from being damaged by the edges of both the ends of the plate-type wire 21 of the coreless coil 20.

The cylinder 25 of the terminal base 24 has a thickness deviation, i.e., the corresponding part to the inner terminal 22 of the coreless coil 20 is thicker than the other part, and the vertical groove 28 is disposed on this thicker part so that the terminal 22 engaged into the groove 28 can be guided, and an engaging groove 47 is disposed within a little distance from the vertical groove 28 so that the bent portion 46 disposed at the inner end of the coreless coil 20 can be engaged with.

Regarding the terminal base 24, a support protrusion 49 is disposed at respective four corners of the base plate 26 with a predetermined distance from the cylinder 25. An opposite face of the support protrusion 49 to the cylinder 25 is tapered (taper 50) so that the coreless coil 20 can be incorporated by guiding with this taper 50. In addition, a tapered notch 51 is provided on a respective support protrusion 49, and an engaging down flap 52 is provided on the respective four corners of the insulating sheet 33. Then, the flap 52 is engaged with the tapered notch 51 thereby positioning the insulating sheet 33.

Another bent portion 46 disposed on the outer end of the coreless coil 20 is engaged with an end face of one of the four support protrusions 49 provided on the base plate 26.

The E and I-shapes magnetic cores 39 and 40 are used as the closing magnetic core 34. On the I-shape magnetic core 40, a cavity portion 44 is provided in order to give a relief to the inner terminal 22 as well as a notch 43 is provided on an opposite edge to the notch 38 of the E-shape magnetic core 39 in order to give a relief to the outer terminal 23.

Figure 22:
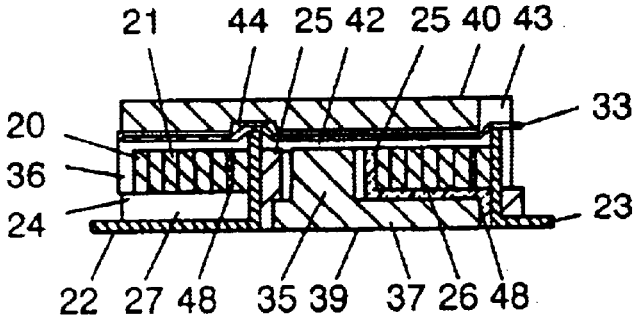
FIG. 22 is a cross section depicting an I-shape magnetic core having a cavity.
Figure 23:
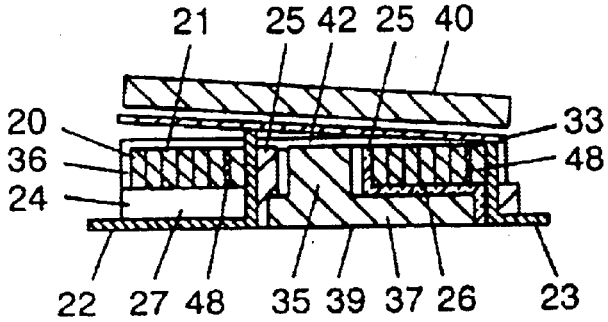
FIG. 23 is a cross section depicting inconvenience when the I-shape magnetic core does not have the cavity.
Figure 24:
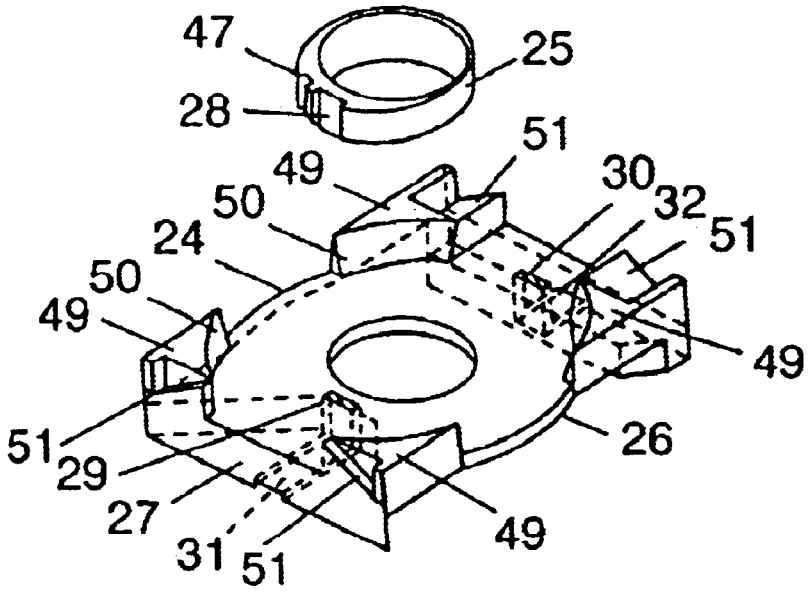
FIG. 24 is an exploded perspective view depicting a cylinder being separated from the terminal base.

If the cavity portion 44 were not provided on the I-shape magnetic core as shown in FIG. 23, and the terminal 22 were protruded above the coreless coil 20, the upper end of the terminal 22 would hit the lower face of the I-shape magnetic core 40, and I-shape magnetic core 40 could not be assembled with the E-shape magnetic core 39. However, when the cavity portion 44 is provided as shown in FIG. 22, the upper end of the terminal 22 gets a relief so that the I-shape magnetic core 40 can be assembled firmly with the E-shape magnetic core 39. The notch 43 on the I-shape magnetic core 40 also functions as well when the terminal 23 protrudes upward.

Figure 11:
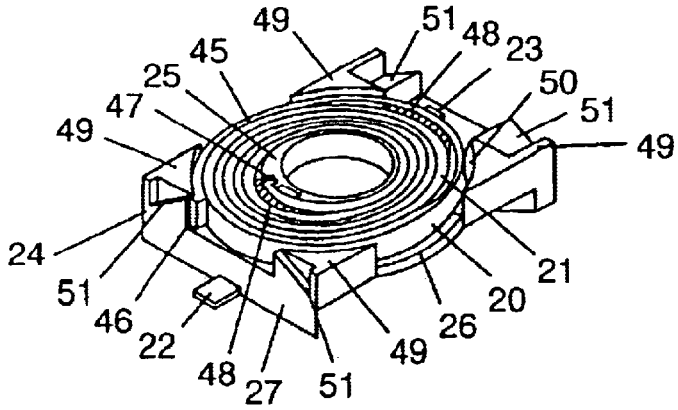
FIG. 11 is a perspective view depicting the coreless coil mounted to the terminal base illustrated in FIG. 10.
Figure 12:
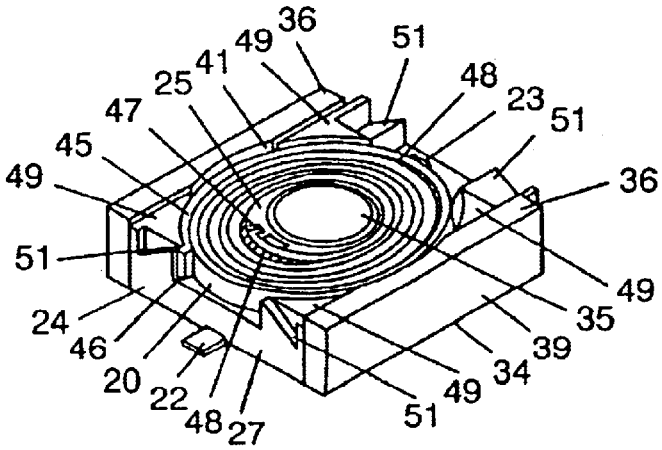
FIG. 12 is a perspective view depicting the assembled elements illustrated in FIG. 10 including the coreless coil, the terminal base and E-shape magnetic core.
Figure 13:
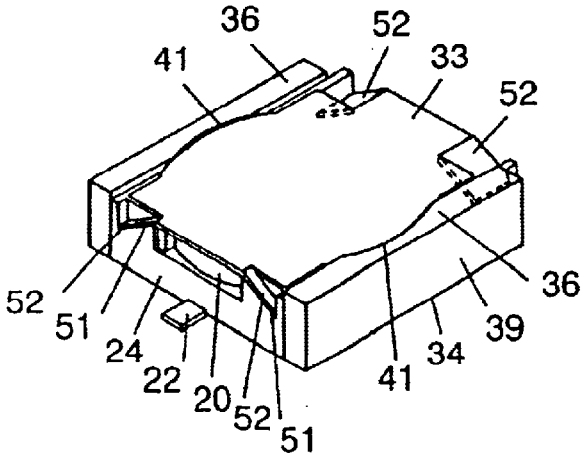
FIG. 13 is a perspective view depicting an insulating paper incorporated into the status shown in FIG. 12.
Figure 14:
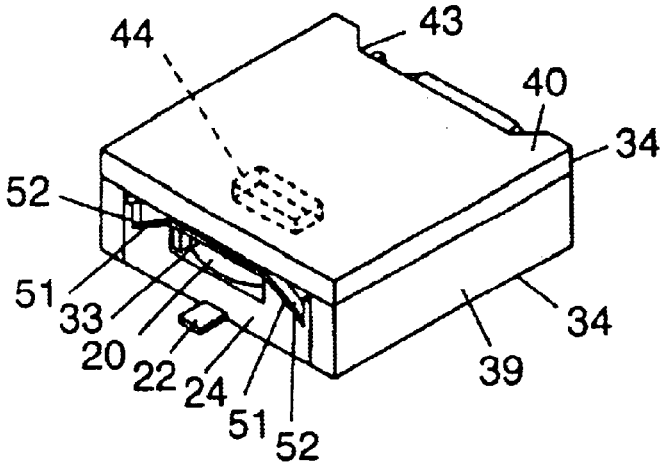
FIG. 14 is a perspective view of a complete product depicted in FIG. 13.
Figure 15:
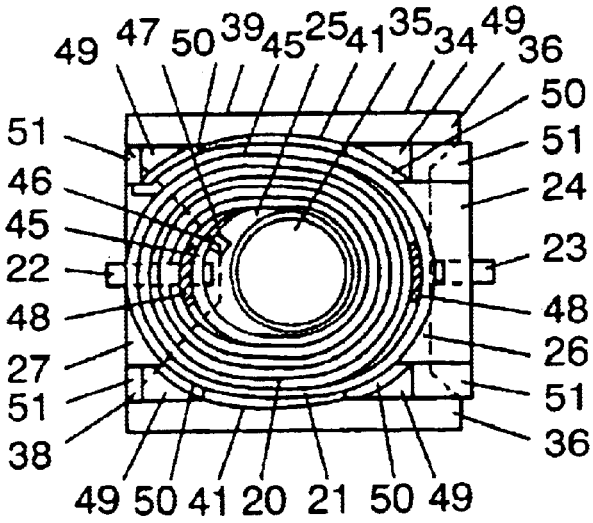
FIG. 15 is a perspective view of the assembled elements illustrated in FIG. 11C including the coreless coil, the terminal base and E-shape magnetic core.
Figure 16:
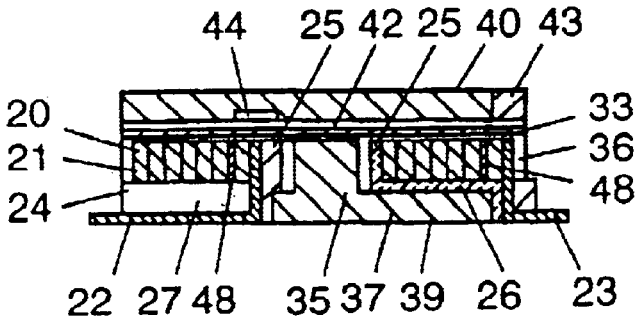
FIG. 16 is a cross section of the complete product depicted in FIG. 14.

In the same structure as described above, the coreless coil 20 having an ellipse inner shape or an oval inner shape is incorporated with the terminal base 24 as shown in FIG. 11 through the following steps: first, a) incorporate the bent portion 46 of the coreless coil 20 with the terminal base 24 by engaging the bent portion 46 with the groove 47 as well as the end face of protrusion 49, second, b) engage the terminals 22, 23 which extends downward through respective holes 29, 30 punched in the terminal base 24 with respective grooves 31, 32, then pull out the terminals 22, 23 to an opposite side with each other, third, c) mount the E-shape magnetic core 39 to the terminal base 24 from the bottom of the base 24 as shown in FIG. 12, and then, d) assemble the flap 52 with the tapered notch 51 so that the insulating sheet 33 can be positioned into the base 24 as shown in FIG. 13, finally, e) mount the I-shape magnetic core 40 on the outer magnetic leg 36 of the E-shape magnetic core 39 so that the choke coil is completed as shown in FIGS. 14 and 16.

The choke coil having the above structure has a lot of advantages, e.g., 1) firm positioning of the coreless coil 20 as well as the insulating sheet 33 is achieved with ease, and 2) a number of defects in assembling the magnetic cores can be reduced.

Figure 20:
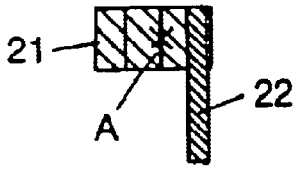
FIG. 20 illustrates inconvenience in coupling the terminals of the coreless coil.
Figure 21:
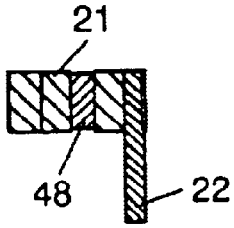
FIG. 21 illustrates a method of coupling the terminals where a spacer is used.

The coreless coil 20 utilized in the above structure is produced through the following steps: first, a) form a bent portion 46 by bending a first end of the plate-type wire 21 at a right angle as shown in FIGS. 17A and 17B, meanwhile, the plate-type wire is made of self welding flat-type-wire, second, b) remove an insulating layer from two parts located within a limited distance from both ends of the wire 21 so that the two parts expose conductive material, third, c) connect the terminals 22, 23 to the exposed parts by caulking or welding, then, d) mount a spacer 48 to respective rear faces of the connected parts as shown in FIG. 21 so that a short circuit (A) as shown in FIG. 20 can be prevented. When the terminals 22, 23 are connected, a burr is produced on the face opposite to the connected part of the terminals, the burr causes a short circuit (A), and, e) coil the plate-type wire and heat the wire to weld each other. Finally, f) form another bent portion 46 by bending a second end of the plate-type wire (i.e., the end of the outer most turn) as shown in FIG. 18. When the bent portions 46 and the extended portions 45 are not necessarily at the ends of coreless coil 20, the structure can be modified as shown in FIG. 19.

Figure 25:
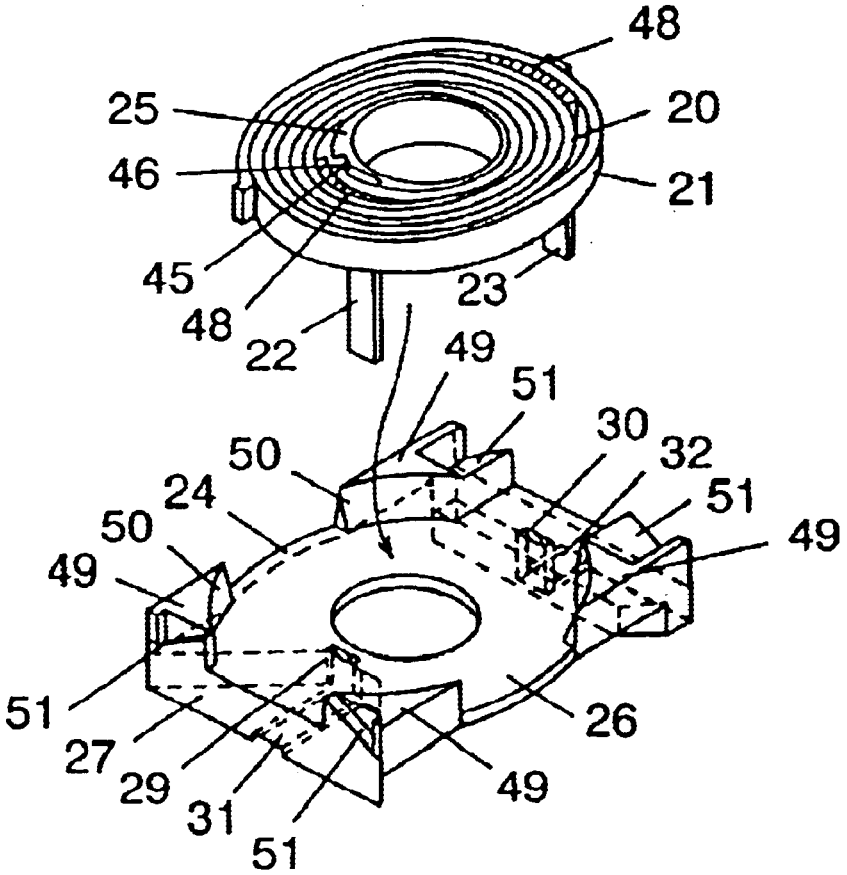
FIG. 25 is an exploded perspective view depicting the coreless coil being incorporated into the cylinder.

In the above structure, the terminal base 24 is described that the cylinder 25 and the base plate 26 are in one molding, however, those two elements can be individually made and coupled to each other by a mechanical method or with bond. In this case, as shown in FIG. 25, the coreless coil 20 can be directly wound to the cylinder, and then the base plate 26 is assembled with the cylinder. This method can improve the production efficiency.

In the above I-shape magnetic core 40, two cavity portions 44 as show in FIG. 27 can be provided in order to give a relief to the edges of the terminals 22, and 23. Instead of the cavity portion 44, a hole 44b giving a relief to the terminal 22 can be provided as shown in FIG. 28.

Embodiment 3

Figure 29:
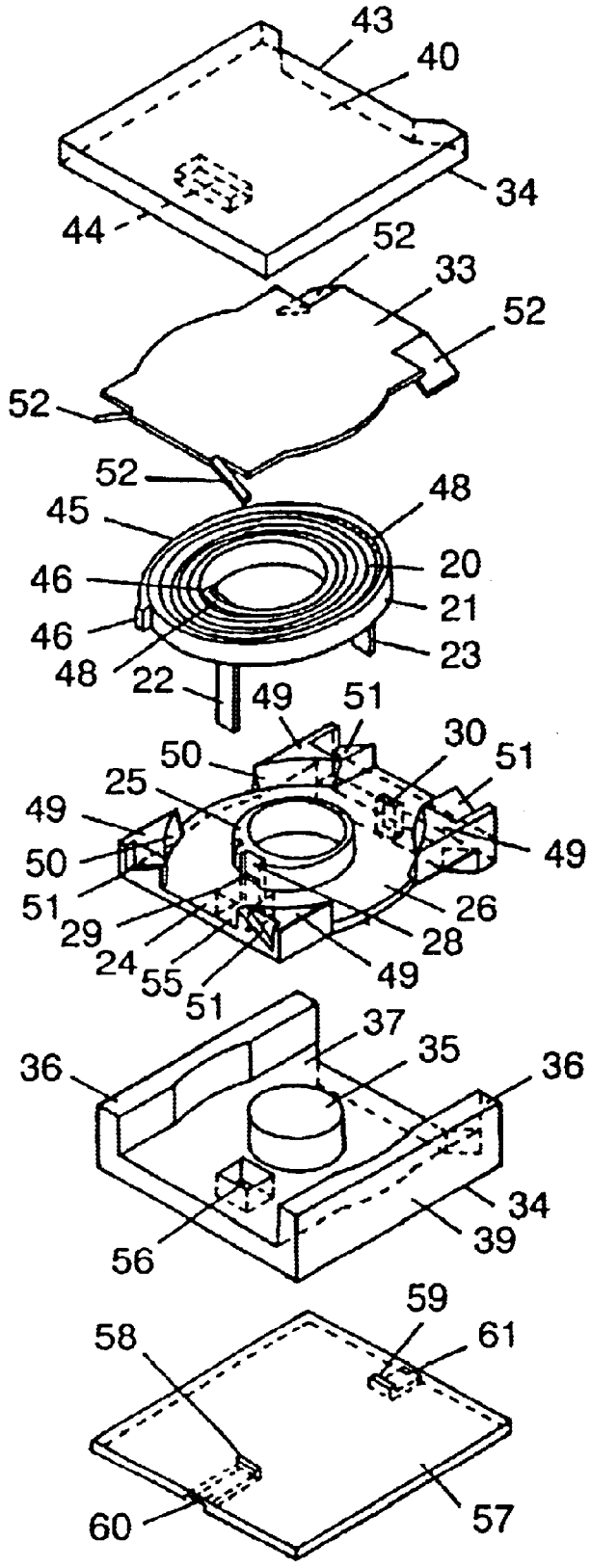
FIG. 29 is an exploded perspective view of the choke coil utilized in the third exemplary embodiment according to the present invention.
Figure 30:
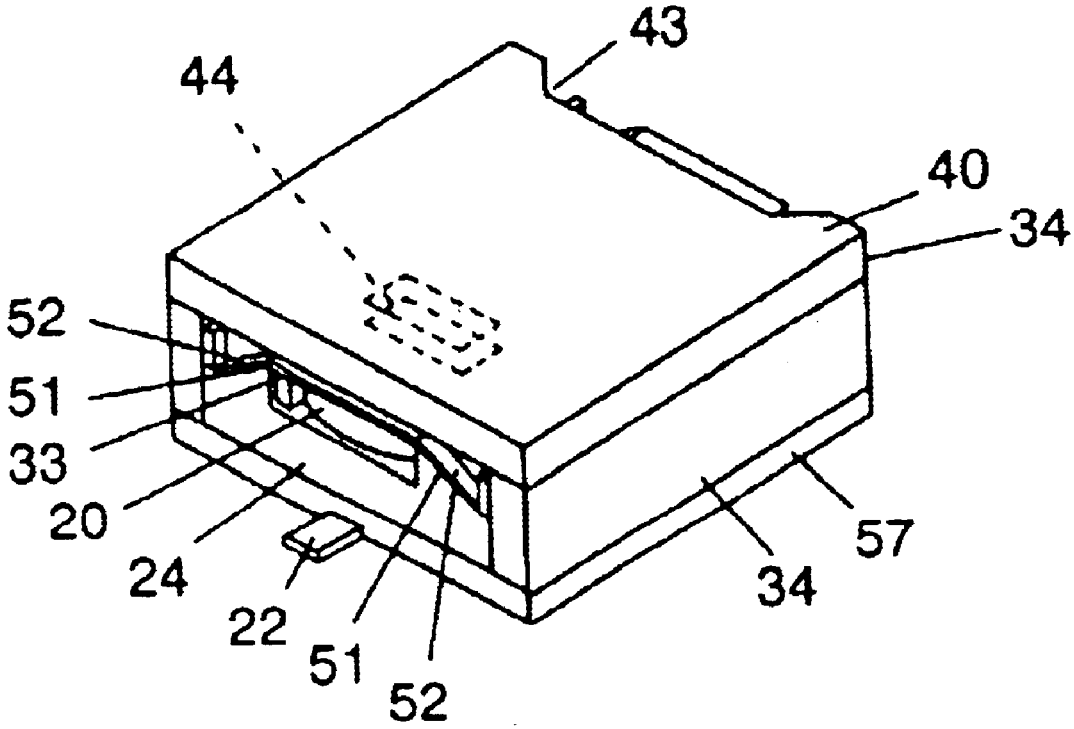
FIG. 30 is a perspective view of a complete product depicted in FIG. 29.
Figure 31:
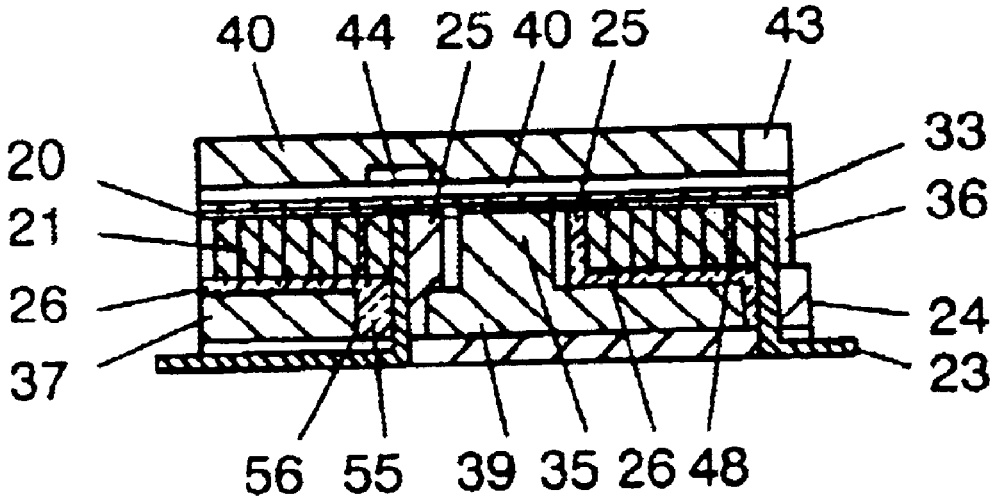
FIG. 31 is a cross section of the complete product depicted in FIG. 29.

The third exemplary embodiment is described hereinafter by referring to FIGS. 29–31. The basic structure is same as that of the second exemplary embodiment, thus different points are only described here. The cylinder 25 of the terminal base 24 has deviates in thickness, i.e., one portion is thicker than another portion, corresponding to the inner terminal 22 of the coreless coil 20, and has a vertical groove 28 which guides the terminal 22 engaged with the corresponding thicker part. A terminal hole 29 through which the terminal 22 extends is punched on the base plate 26 and an annexed square protrusion 55 both are provided at the lower end of the vertical groove 28. Another terminal hole 30 is punched on the base plate 26 to which the terminal 23 coupled with the outer end of the coreless coil corresponds. The coreless coil 20 is assembled into the terminal base 24, and then the closing magnetic core 34 is assembled thereto. This closing magnetic core 34 comprises the E-shape magnetic core 39 and the I-shape magnetic core 40. On the common magnetic yoke 37 of the E-shape magnetic core 39, a through hole 56 is punched into which the square protrusion 55 can be fit.

On the insulating plate 57, terminal holes 58 and 59 are punched to accept the terminals 22 and 23, which extend from the bottom side of the coreless coil 20. On the rear side of the insulating plate 57, terminal grooves 60 and 61 are provided adjacent to the holes 58 and 59.

In the above structure, the coreless coil 20 is assembled into the terminal base 24, and the square protrusion 55 is fit into the through hole 56 punched on the common magnetic yoke 37 of the E-shape magnetic core 39 for positioning. Then, the terminals 22 and 23 extended from the bottom side of the coreless coil 20 is led out from the terminal holes 58 and 59. The insulating plate 57 is mounted beneath the bottom of the E-shape magnetic core 39. The terminals 22 and 23 extended from the bottom face of the insulating plate are bent so that the terminals 22 and 23 can be fit into the terminal grooves 60 and 61, and then, the terminals are led out from sides of the insulating plate 57. Finally, the insulating sheet 33 is assembled and the I-shape magnetic core 40 is assembled thereto, and the choke coil is completed as shown in FIGS. 30 and 31.

The choke coil produced in the above structure has the following advantages, 1) a firm positioning of the coreless coil 20, the terminals 22 and 23 can be achieved, and 2) the closing magnetic core 34 is insulated from the mounting substrate. As a result, a choke coil suitable for being mounted onto the substrate can be obtained.

Embodiment 4

Figure 32A:
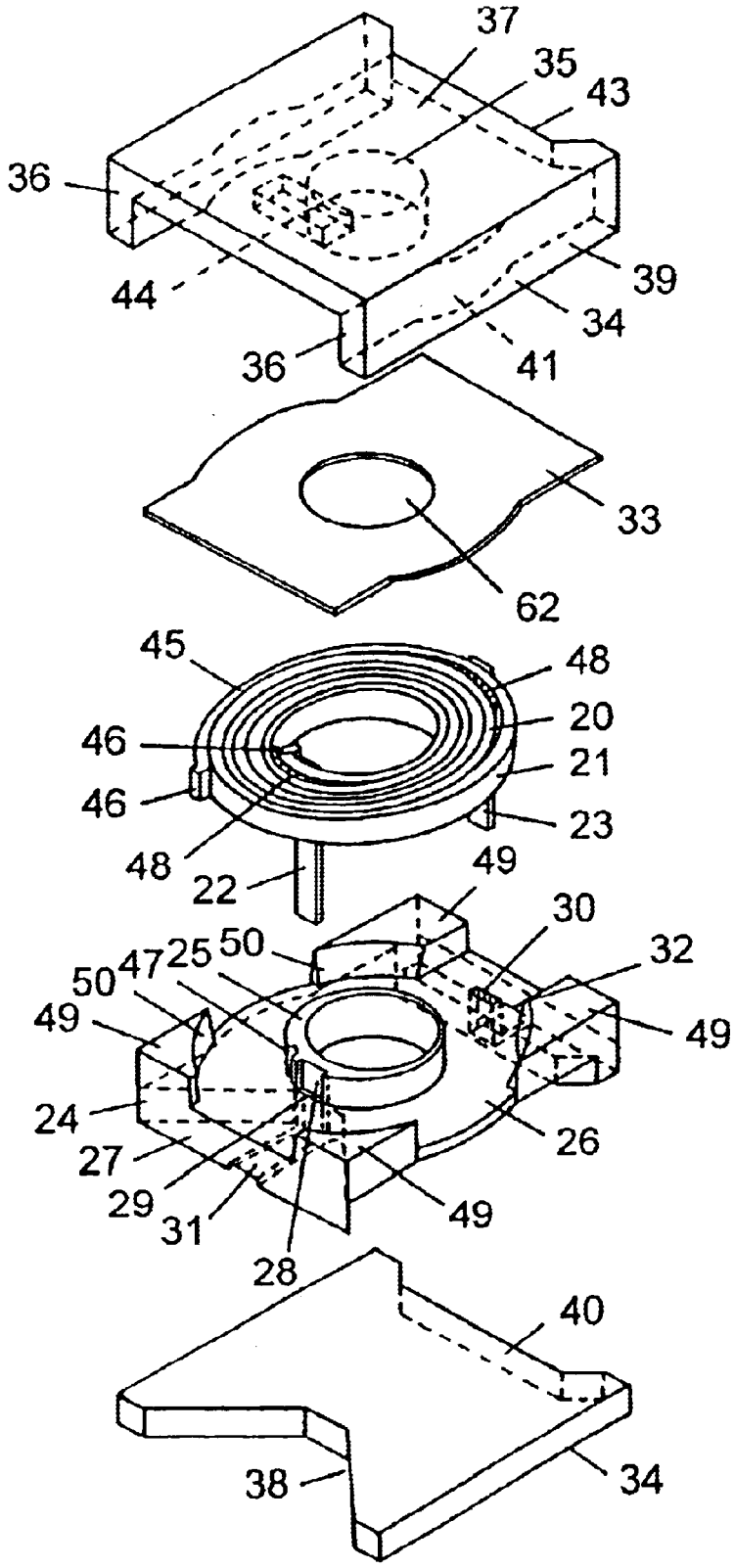
FIG. 32A is an exploded perspective view of the choke coil utilized in the fourth exemplary embodiment according to the present invention.
Figure 32B:
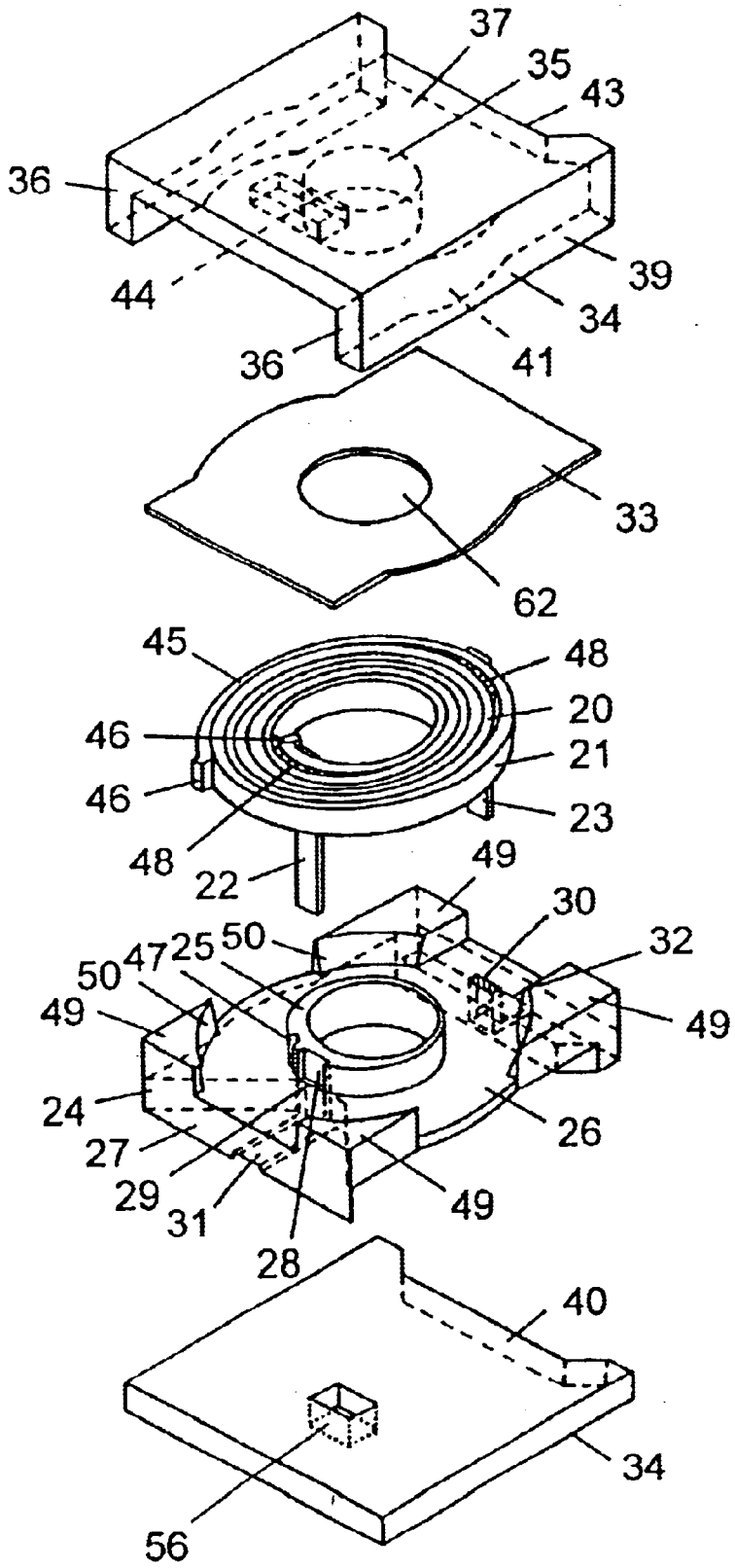
FIG. 32B is an exploded perspective view of another configuration of the choke coil utilized in the fourth embodiment.
Figure 33:
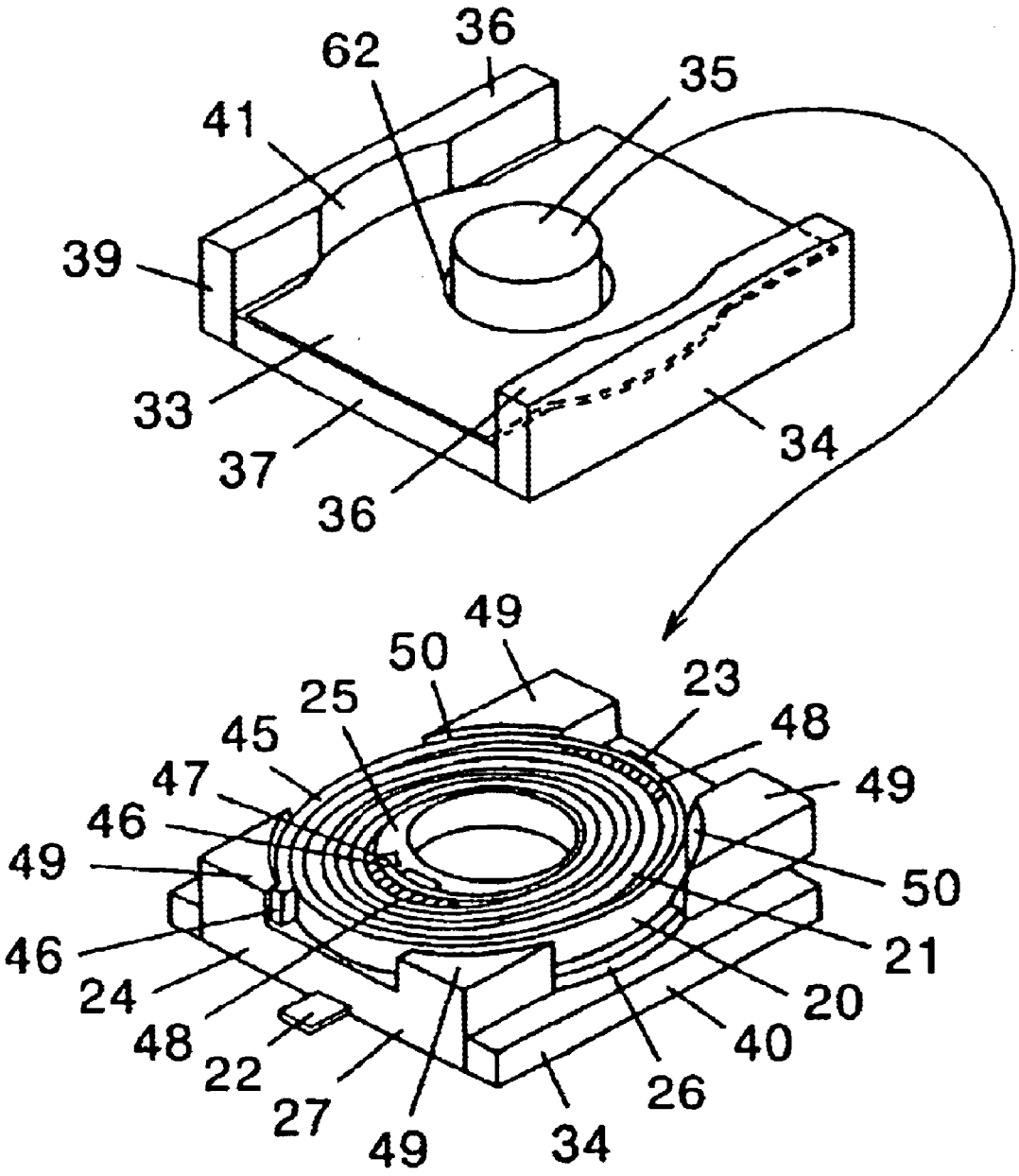
FIG. 33 is an exploded perspective view of the assembled elements illustrated in FIG. 32A including the coreless coil, terminal base, I-shape magnetic core and the insulating sheet.

The fourth exemplary embodiment is described hereinafter by referring to FIGS. 32A and 33–35, and another configuration of the fourth embodiment is shown in FIG. 32B. The basic structure is same as that of the second exemplary embodiment, thus different points only are described here. Regarding the terminal base 24, the support protrusions 49 disposed on each corner of the base plate 26 do not have a tapered notch 51 which could position the insulating sheet 33, and only a taper 50 is provided instead. The taper 50 guides the coreless coil 20 when the coreless coil 20 is assembled. The notch 38 is provided on the I-shape magnetic core 40 of the closing magnetic core 34. The notch 43 is provided on an edge of the E-shape magnetic core 39 of the closing magnetic core 34, and the cavity portion 44 is provided inside of the E-shape magnetic core 39. The insulating sheet 33 does not have the flap 52 for positioning, but has a hole 62 corresponding to the center magnetic leg 35 instead. In the choke coil illustrated in FIG. 32B, the through hole 56 is provided in the I-shape magnetic core 40 of the closing magnetic core 34, and the inner terminal 22 exits the I-shape magnetic core via the through hole 56.

Figure 34:
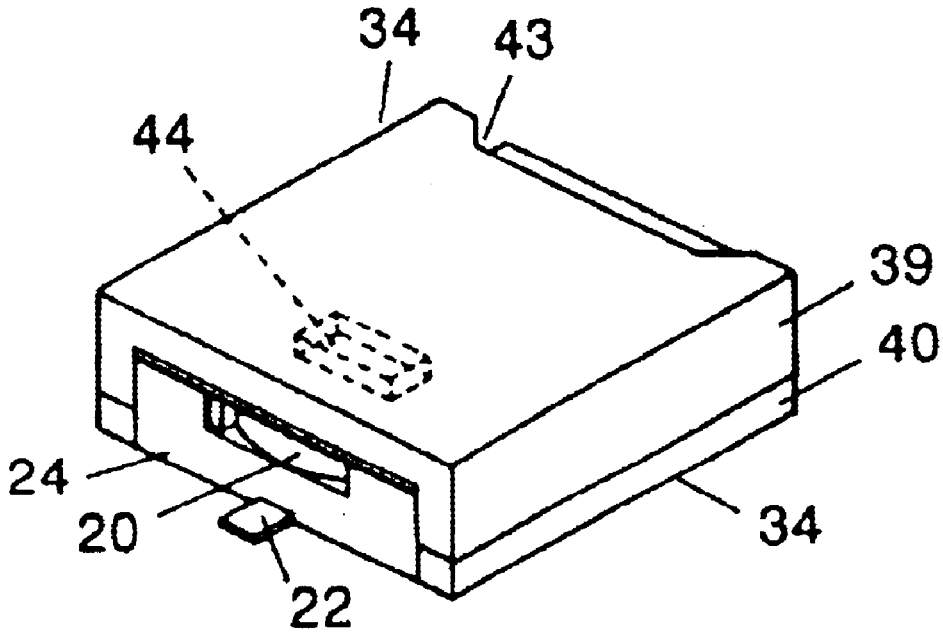
FIG. 34 is a perspective view of a complete product depicted in FIG. 33.
Figure 35:
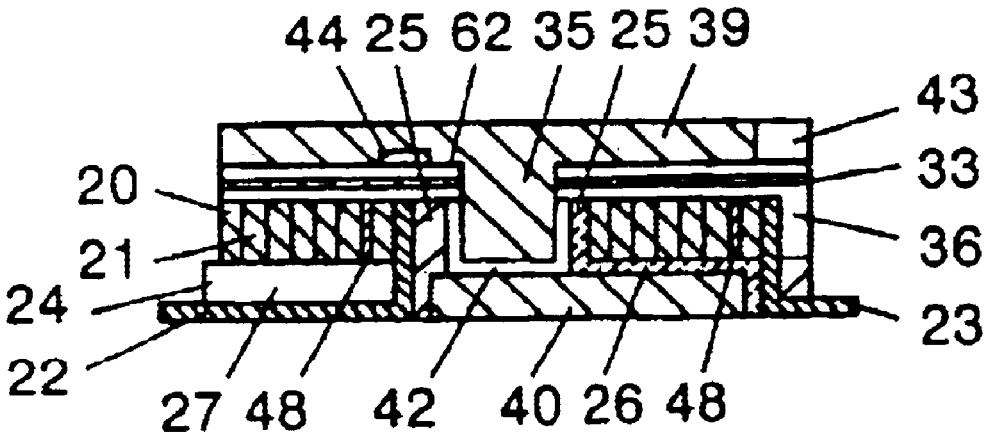
FIG. 35 is a cross section of the complete product depicted in FIG. 33.
Figure 36:
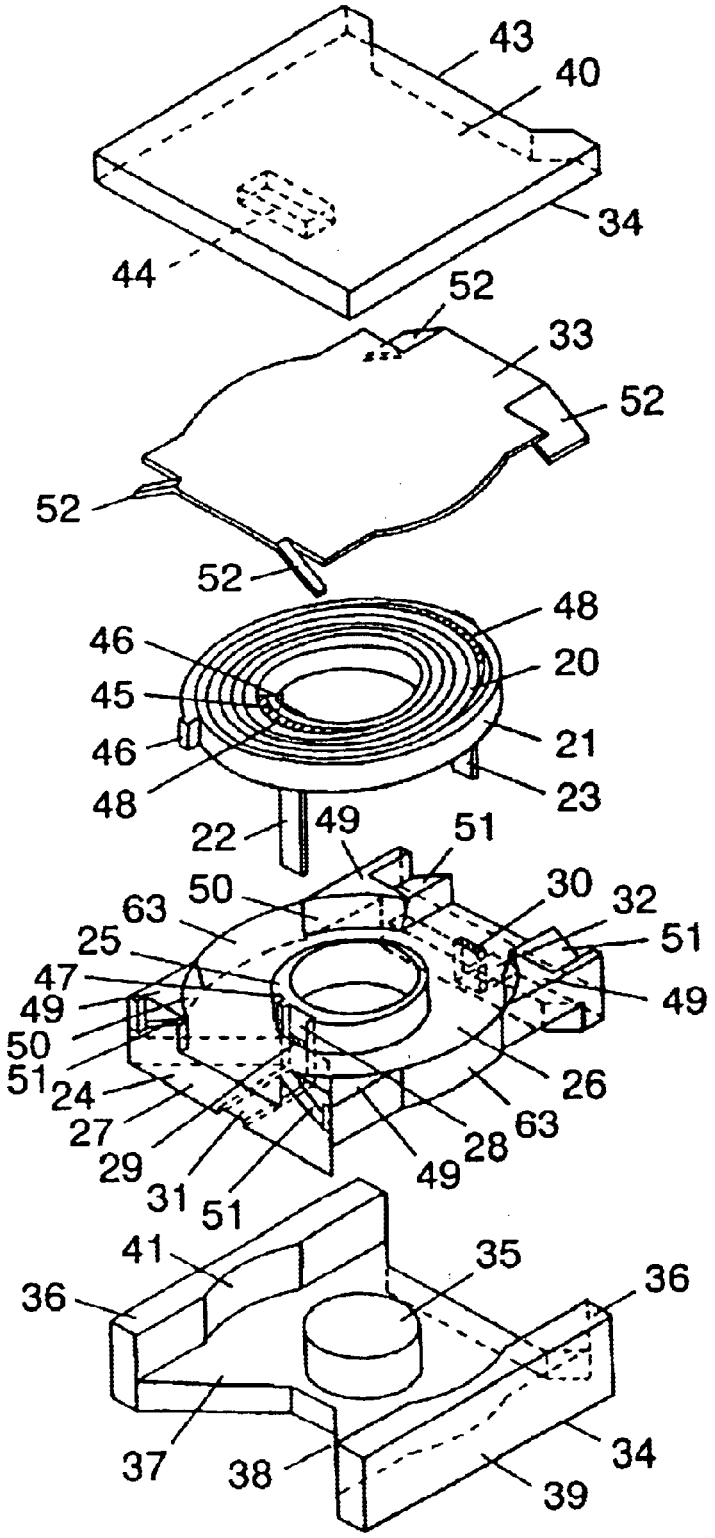
FIG. 36 is an exploded perspective view depicting the choke coil utilized in the fifth exemplary embodiment according to the present invention.
Figure 37:
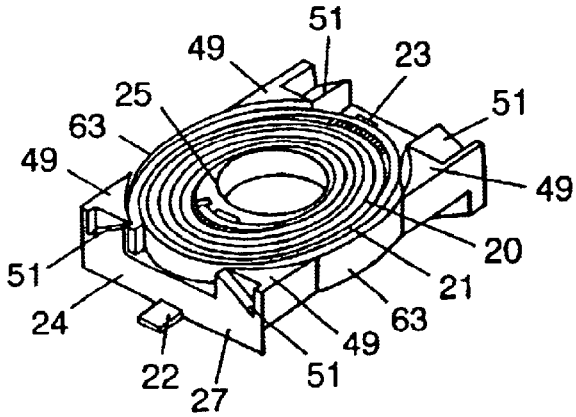
FIG. 37 is a perspective view depicting the assembled elements illustrated in FIG. 36 including the coreless coil and the terminal base.

According to this structure, the choke coil illustrated in FIGS. 34 and 35 are assembled through the following steps: first, a) incorporate the coreless coil 20 with the I-shape magnetic core 40, second, b) bend the terminals 22 and 23 and fit them into the terminal base 24 to join the coreless coil 20 to the triangular protrusion 27, third, c) fit the triangular protrusion 27 into the notch 38 for positioning, then, d) fit the hole 62 of the insulating sheet 33 into the center magnetic leg 35 of the E-shape magnetic core 39, and finally, e) incorporate the E-shape magnetic core 39 with the terminal base 24 by fitting the center magnetic leg 35 into the cylinder 25, which ensures the positioning of the E-shape magnetic core 39. The choke coil illustrated in FIGS. 34 and 35 is thus completed.

This structure has the following advantages: 1) the I-shape magnetic core 40 is automatically positioned by the terminal base 24, and 2) the insulating sheet 33 is positioned by the center magnetic leg 35 of the E-shape magnetic core 39. These advantages benefit the choke coil when it is manufactured.

Embodiment 5

The fifth exemplary embodiment is described hereinafter by referring to FIGS. 36–41. In those Figs., the coreless coil 20, closing magnetic core 34, and insulating sheet 33 have the same structures as those in the second exemplary embodiment, while only the terminal base 24 has a different structure. Namely, the terminal base 24 to which the coreless coil 20 is mounted forms a case comprising the cylinder 25, the base plate 26 and an insulating wall 63. The insulating wall 63 functions as an insulating layer between the coreless coil 20 and both the outer magnetic legs 36, and is disposed on the outer edge of the base plate 26.

Figure 38:
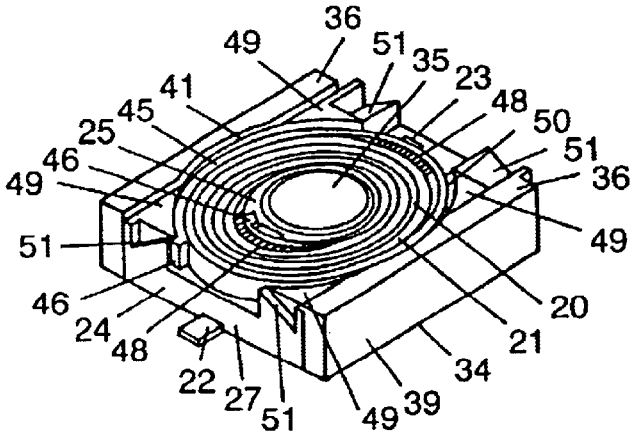
FIG. 38 is a perspective view depicting the assembled elements illustrated in FIG. 36 including the coreless coil, terminal base, E-shape magnetic core.
Figure 39:
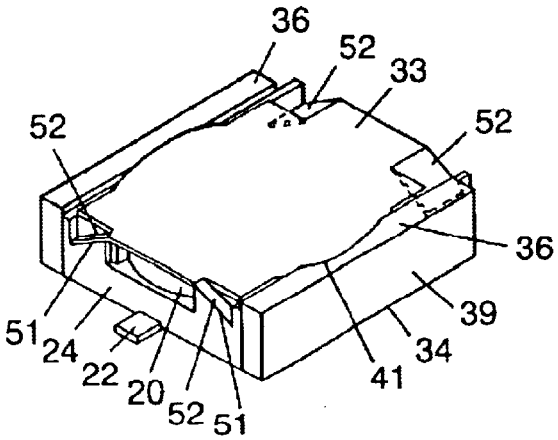
FIG. 39 is a perspective view depicting the insulating sheet being further assembled with the elements illustrated in FIG. 38.
Figure 40:
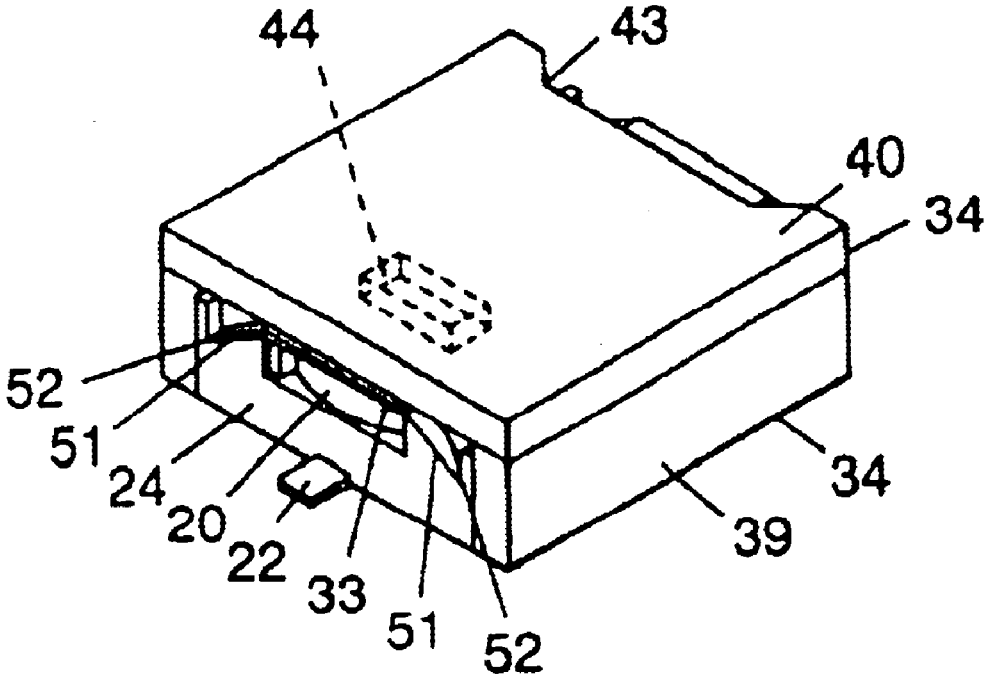
FIG. 40 is a perspective view of a complete product depicted in FIG. 36.
Figure 41:
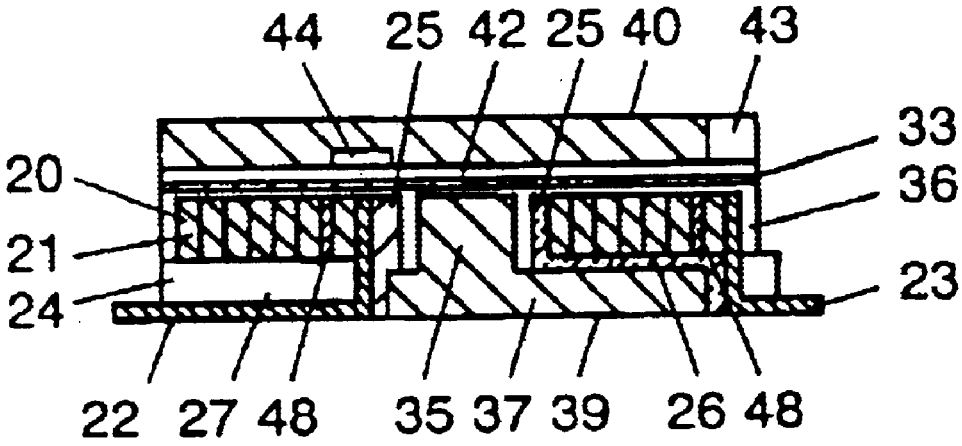
FIG. 41 is a cross section of the complete product depicted in FIG. 36.
Figure 42:
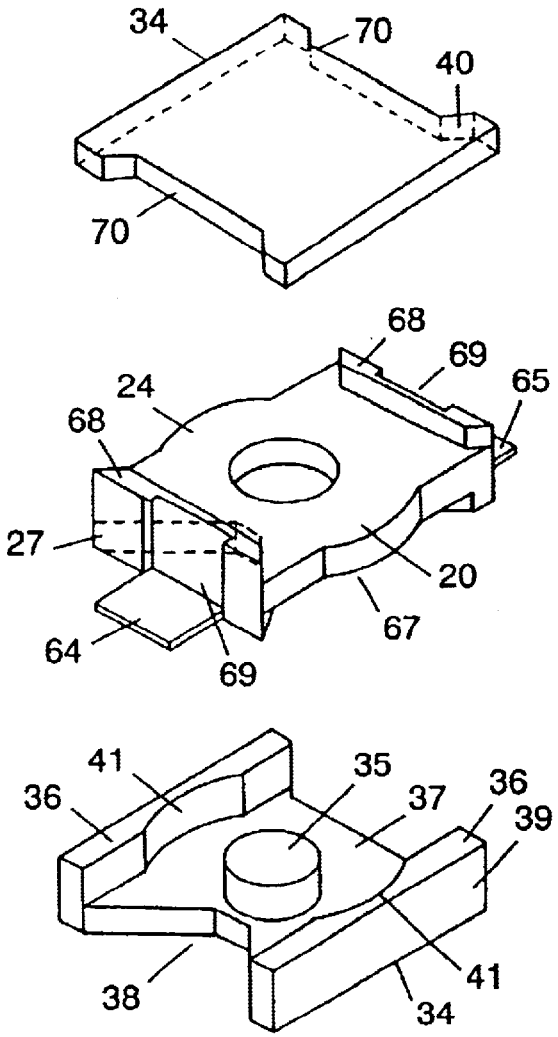
FIG. 42 is an exploded perspective view of the choke coil utilized in the sixth exemplary embodiment.

According to the above structure, the choke coil illustrated in FIGS. 40 and 41 is assembled through the following steps: first, a) incorporate the coreless coil 20 with the terminal base 24 shaped like a case, second, b) bent the terminals 22 and 23, third, c) insert the cylinder 25 into the center magnetic leg 35 of the E-shape magnetic core 39, the assembled product up to this point is illustrated in FIG. 38, d) position the insulating sheet 39 on the terminal base 24 as shown in FIG. 39, and e) incorporate the I-shape magnetic core 40 thereon, and complete the choke coil.

In this structure, the terminal base 24 has the insulating wall 63 on the outer edge of the base plate 26, and the terminal base 24 is shaped like a case. This structure provides the following advantage: the outer turn of coreless coil 20 is insulated from the outer magnetic leg 36 of the closing magnetic core 34, whereby a damage to the coreless coil 20 in the assembly process can be prevented, and as a result, work efficiency and product reliability are improved.

Embodiment 6

The sixth exemplary embodiment is described hereinafter by referring to FIGS. 42–46.

Figure 46:
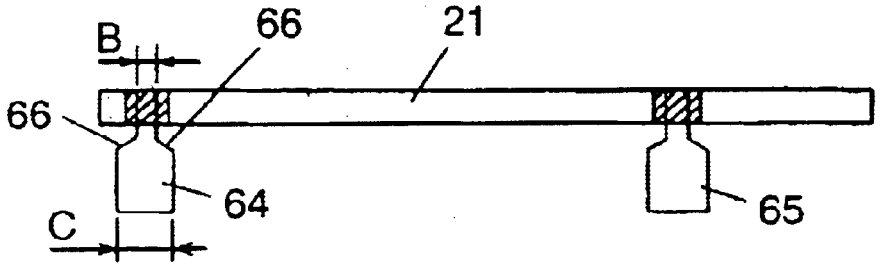
FIG. 46 is a front view of a coreless coil before being coiled and used in the sixth exemplary embodiment.
Figure 47:
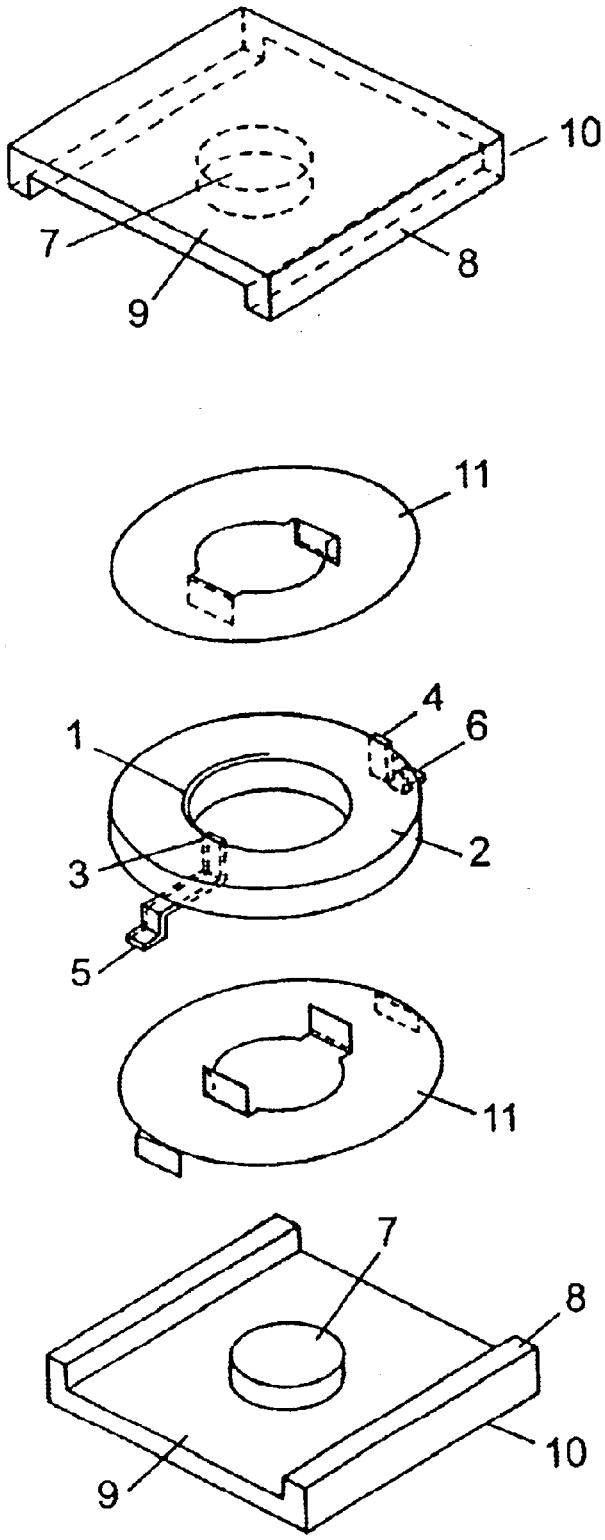
FIG. 47 PRIOR ART
FIG. 47 is an exploded perspective view of a conventional choke coil.
Figure 48:
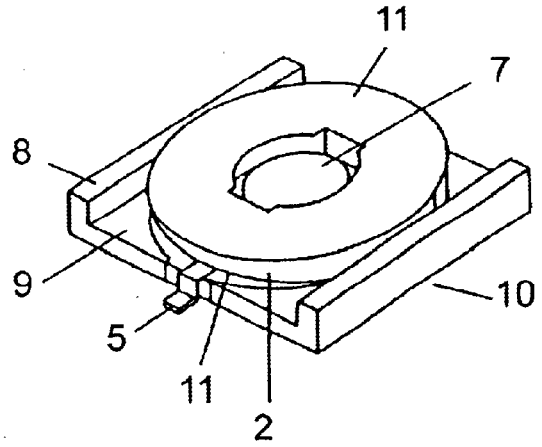
FIG. 48 PRIOR ART
FIG. 48 is a perspective view depicting the assembled elements in FIG. 47 including the coreless coil, terminal base and E-shape magnetic coil.
Figure 49:
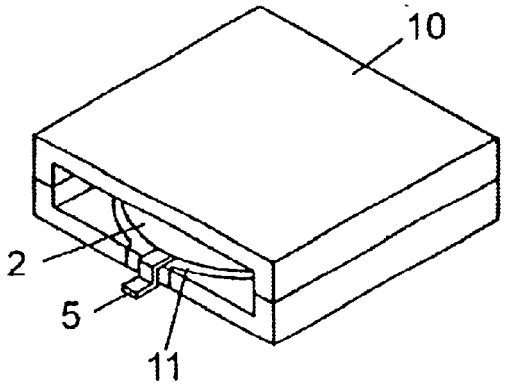
FIG. 49 PRIOR ART
FIG. 49 is a perspective view of a completed product depicted in FIG. 47.
Figure 50:
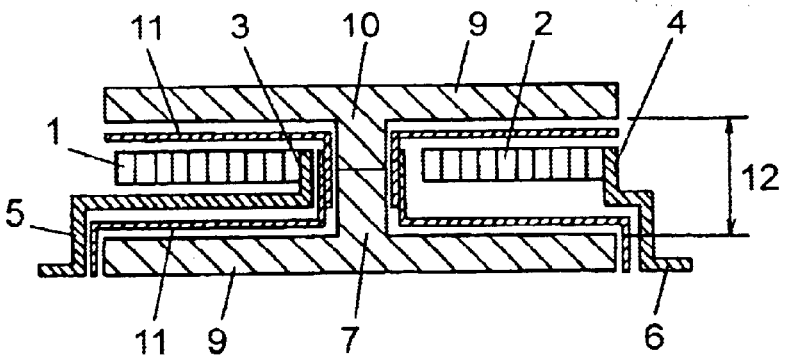
FIG. 50 PRIOR ART
FIG. 50 is a cross section of the completed product.
Figure 51:
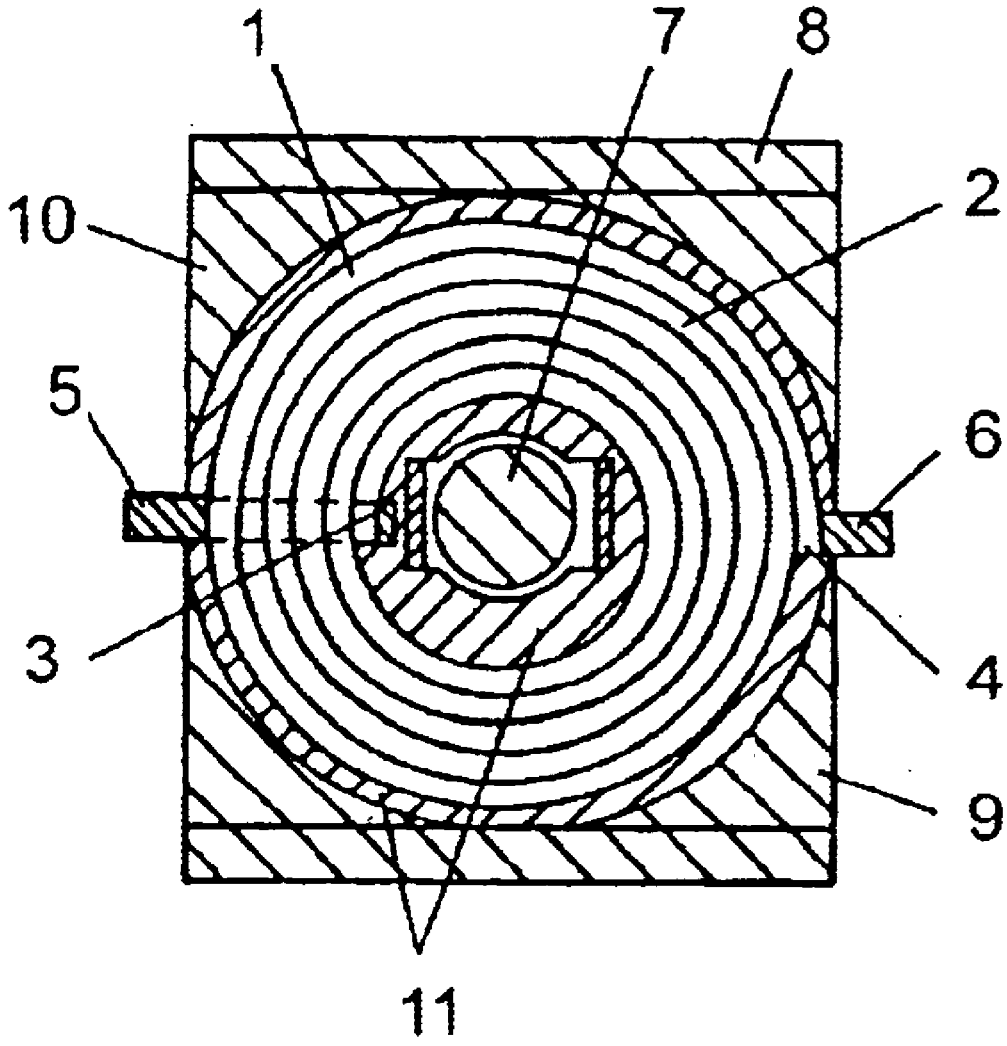
FIG. 51 PRIOR ART
FIG. 51 is a top view depicting a top view of the assembled elements illustrated in FIG. 47 including the coreless coil, terminal base and E-shape magnetic core.

The coreless coil 20 in this embodiment is made of flat type wire or foil type wire 21. The wire coils itself, and forms the coreless coil 20. Plate-type terminals 64 and 65 are connected to the plate-type conductor 21 by ultrasonic bonding or welding at places near to both the ends of the conductor 21 as shown in FIG. 46. The terminals 64 and 65 comprises a first part having a width B which is connected to the conductor 21 and a second part having a wider width C. A taper 66 is formed at respective boundary parts between the first and second parts in order to absorb the width difference. Since lead sides of the terminals 64 and 65 have a wider area, a more stable mounting can be expected and heat dissipation of the coreless coil 20 is improved. The taper 66 smoothes a current running on the terminals 64 and 65 as well as increases the strength of the terminals against bending force. Thanks to the ultrasonic bonding or welding employed to connecting the terminals 64 and 65 to the plate-type conductor 21, the connection cannot be broken due to the heat applied to the circuit board during mounting process. The coreless coil 20 coupled to the terminals 64 and 65 is molded into the terminal base 24 by insulating synthetic resin, which forms a coil part 67. On the terminal base 24, the triangular protrusion 27 is provided on one side of a bottom face, a protrusion 68 is provided on both the end faces of the upper face, and a cavity is provided on both the sides so that the terminals 64 and 65 fit the cavities when the terminals are bent.

The closing magnetic core 34 is incorporated with the coil part 67. The closing magnetic core 34 comprises E-shape magnetic core 39 and I-shape magnetic core 40 both made of manganese ferrite sintered body. On the common magnetic yoke 37 of the E-shape magnetic core 39, the notch 38 is provided so that the triangular protrusion 27 can be fit therein. On the I-shape magnetic core 40, a notch 70 is provided on the edges opposite to each other into which the protrusions 68 provided on the terminal base 24 can be fit.

The terminal 64 coupled to the inner face of the coreless coil 20 is led out with a slant, so that the terminal 65 coupled to the outer face of the coreless coil 20 can be led out at the bottom of the terminal base 24 with an identical form to the terminal 64. Accordingly, both of the terminals do not have any difference in direction when the choke coil is mounted to the substrate. As a result, mounting efficiency is improved.

Figure 44:
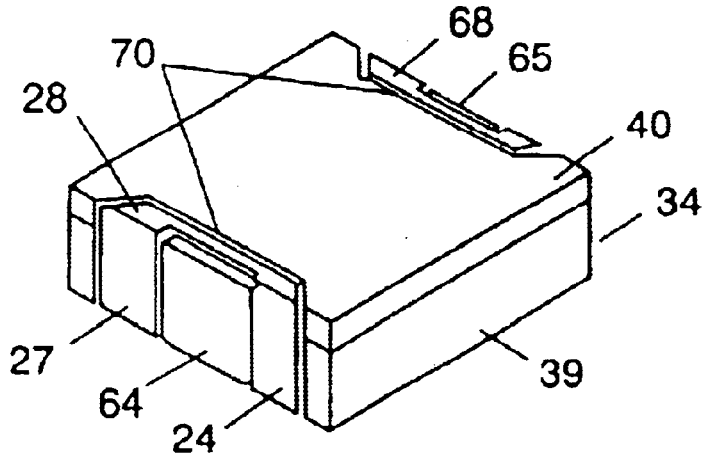
FIG. 44 is a perspective view of a complete product illustrated in FIG. 42.
Figure 45:
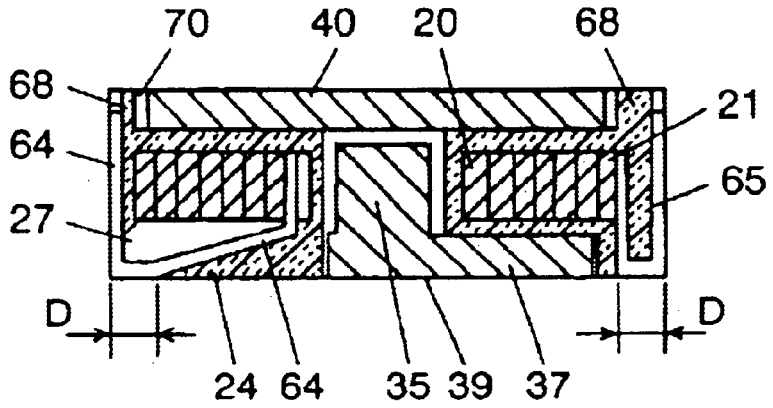
FIG. 45 is a cross section of the complete product.

The choke coil illustrated in FIGS. 44 and 45 is assembled through the following steps: first, a) incorporate the E-shape magnetic core 39 having the cylindrical center magnetic leg 35 with the terminal base 24 (i.e., the coil part 67) from its bottom face, second, b) fit the triangular protrusion 27 into the notch 38 for ensuring the positioning, third, c) fit the protrusion 68 of the terminal base 24 into the notch 70 so that the I-shape magnetic core 40 is incorporated with the terminal base 24, and finally, d) bend upward the terminals 64 and 65 led out from the bottom face of the terminal base 24 to fit into the cavity 69 provided on the side faces of the terminal base 24. The choke coil is thus completed.

The above structure has the following advantages: 1) the coreless coil 20 is mounted on the face contacted to the closing magnetic core 34 via an insulating layer because the surface of coreless coil 20 is molded by insulating synthetic resin, as a result, no damage is expected to the coreless coil 20, the terminals 64 and 65 in the assembly process. Also, heat dissipation of the coreless coil 20 is improved, and the size thereof as well as a number of components can be reduced, 2) since the positioning is achieved between the protrusion 68 of the terminal base 24 and the notch 70 of the I-shape magnetic core 40, assembly efficiency and product reliability are improved, and 3) because the terminals 64 and 65 are fit into the cavity 69 on the side face of the terminal base 24, a mounting space on the mounting substrate can be reduced.

Figure 43:
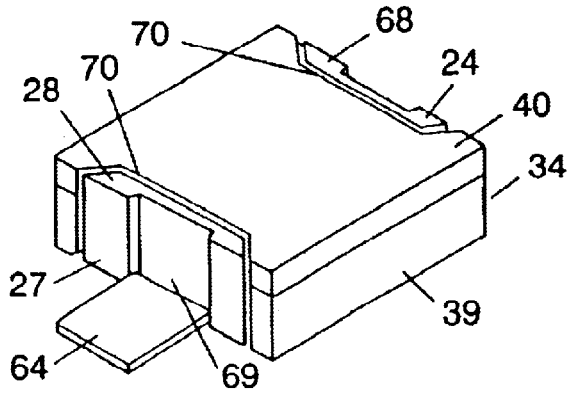
FIG. 43 is a perspective view depicting the choke coil on the way of assembly.

Regarding the terminals 64 and 65, the choke coil as shown in FIG. 43 can be mounted depending on a certain condition. The notch 38 accepting the triangular protrusion 27 can be provided on the I-shape magnetic core 40. The notch 70 accepting the protrusion 68 of the terminal base 24 can be provided on the E-shape magnetic core.

Industrial Applicability

As discussed in the above embodiments, the choke coil of the present invention comprises the following elements: (a) a closing magnetic core including a center magnetic leg, outer magnetic legs and a common magnetic yoke, (b) an coreless coil coiling a plate-type wire made of flat-type wire or foil-type wire to form itself, the coreless coil being mounted to the center magnetic leg of the closing magnetic core, where two terminals are coupled to respective ends of the plate-type wire of the coreless coil, and at least one of the terminals disposed at an inner turn of the coreless coil is led out to outside through a notch or an opening provided on either side of the common magnetic yoke of the closing magnetic core. Accordingly the thickness of the inside terminal of the closing magnetic core does not influence a window height of the closing magnetic core, thereby eliminating a dead space along the window height direction, increasing a space factor, lowering the window height of the closing magnetic core. On the other hand, the thickness of the inside terminal can be increased, i.e., the sectional area of the terminal can be widened to accommodate a larger current. As a result, the choke coil of thinner and lower in size and accomodating a larger current can be produced.

Further, when the coreless coil is mounted on a face contacted to the closing magnetic core via an insulating layer, the coreless coil and the terminals are prevented from being damages during assembly. As a result, a choke coil of better efficiency in assembly and the higher reliability can be produced.

What is claimed is:

1. A choke coil comprising:

a closing magnetic core including a first magnetic core comprising a center magnetic leg, an outer magnetic leg, and a first common magnetic yoke, and a second magnetic core comprising a second common magnetic yoke in contact with said first magnetic core;

a coreless coil including a plate-type wire comprising at least one of a flat type wire and a foil type wire, wherein said coreless coil is disposed around the center magnetic leg and separated therefrom by an insulating layer; and inside and outside terminals respectively coupled to inside and outside ends of the plate-type wire of the coreless coil, wherein one of said first common magnetic yoke and said second magnetic yoke has a substantially planar body portion having first and second sides with a predetermined thickness therebetween and a notch formed in the planar body portion, the notch extending between the first and second planar sides, and wherein said inside terminal extends outside said closing magnetic core through said notch, said inside terminal having a portion that extends substantially parallel with said planar body portion inside the notch within the thickness of said planar body.

2. The choke coil as defined in claim 1, wherein the insulating layer comprises a terminal base.

3. The choke coil as defined in claim 2, wherein said terminal base comprises a base plate and a cylinder, located in a center of the terminal base, wherein said cylinder engages with the center magnetic leg.

4. The choke coil as defined in claim 2, wherein said terminal base comprises a cylinder, coupled to a separate base plate.

5. The choke coil as defined in claim 2, wherein said terminal base comprises a base plate having a support protrusion at each corner thereof.

6. The choke coil as defined in claim 5, wherein said terminal base further comprises a cylinder engaging with the center magnetic leg, and each of said support protrusions at each corner has a taper on a face opposing the cylinder.

7. The choke coil as defined in claim 2, wherein the coreless coil is incorporated into said terminal base as one molding.

8. The choke coil as defined in claim 1, wherein said first magnetic core and said second magnetic core of said closing magnetic core comprise at least one of an EE-shape, an EI-shape, and a TU-shape.

9. The choke coil as defined in claim 8, wherein said closing magnetic core comprises a manganese ferrite core.

10. The choke coil as defined in claim 1, wherein a magnetic gap is provided between said center magnetic leg of said first magnetic core and said second magnetic core.

11. The choke coil as defined in claim 1, wherein said center magnetic leg of said first magnetic core has a cross section shaped in at least one of a circle, an ellipse, and an oval.

12. The choke coil as defined in claim 1, wherein one of a cavity, a notch, and a hole is provided at a place corresponding to the inside terminal in the other of the first and second common magnetic yokes opposite the notch formed in one of the first and second common magnetic yokes.

13. The choke coil as defined in claim 1, wherein said coreless coil is shaped in at least one of a circle, an oval, and an ellipse responsive to a shape of said center magnetic leg.

14. The choke coil as defined in claim 1, further comprising an insulating sheet provided between the coreless coil and the closing magnetic core.

15. The choke coil as defined in claim 1, wherein the inner terminal and the outer terminal each comprise at least one of a plate-type terminal and a pin-type terminal.

16. The choke coil as defined in claim 1, wherein the insulating layer includes a positioning protrusion that fits into the at least one of the notches.

17. The choke coil as defined in claim 1, wherein the portion of the inside terminal that extends substantially parallel with the planar body portion, is substantially flush with one of the first and second sides thereof.

18. The choke coil as defined in claim 14, wherein said insulating sheet includes at least one of an opening which fits into the center magnetic leg of the closing magnetic core, and an engaging part at each outside corner thereof.

19. A choke coil comprising:

a closing magnetic core including a first magnetic core comprising a center magnetic leg, an outer magnetic leg, and a first common magnetic yoke, and a second magnetic core comprising a second common magnetic yoke in contact with said first magnetic core;

a coreless coil including a plate-type wire comprising at least one of a flat type wire and a foil type wire, wherein said coreless coil is disposed around the center magnetic leg and separated therefrom by an insulating layer; and inside and outside terminals respectively coupled to inside and outside ends of the plate-type wire of the coreless coil, wherein said inside terminal is led outside said closing magnetic core through at least one of a notch in the first common magnetic yoke and a notch in the second common magnetic yoke, and wherein said inside terminal is led outside said closing magnetic core through at least one of:

a notch in the first common magnetic yoke;

a through hole in the first common magnetic yoke;

a notch in the second common magnetic yoke; and a through hole in the second common magnetic yoke, wherein said insulating layer comprises a terminal base, wherein said terminal base comprises a base plate and a cylinder, located in a center of the terminal base, wherein said cylinder engages with the center magnetic leg, and wherein a thickness of a wall of said cylinder of the terminal base varies from a minimum thickness to a maximum thickness, and wherein a guiding portion is provided at the point of maximum thickness of the wall of said cylinder and the guiding portion engages with the inner terminal of the coreless coil.

20. A choke coil comprising:

a closing magnetic core including a first magnetic core comprising a center magnetic leg, an outer magnetic leg, and a first common magnetic yoke, and a second magnetic core comprising a second common magnetic yoke in contact with said first magnetic core;

a coreless coil including a plate-type wire comprising at least one of a flat type wire and a foil type wire, wherein said coreless coil is disposed around the center magnetic leg and separated therefrom by an insulating layer; and inside and outside terminals respectively coupled to inside and outside ends of the plate-type wire of the coreless coil, wherein the inside terminal is led outside the closing magnetic core through at least one of a notch and a through hole provided in the first common magnetic yoke; and wherein a thickness of the second common magnetic yoke is 65–90% of a thickness of the first common magnetic yoke.

21. A choke coil comprising:

a closing magnetic core including a first magnetic core comprising a center magnetic leg, an outer magnetic leg, and a first common magnetic yoke, and a second magnetic core comprising a second common magnetic yoke in contact with said first magnetic core;

a coreless coil including a plate-type wire comprising at least one of a flat type wire and a foil type wire, wherein said coreless coil is disposed around the center magnetic leg and separated therefrom by an insulating layer; and inside and outside terminals respectively coupled to inside and outside ends of the plate-type wire of the coreless coil, wherein the inside terminal is led outside the closing magnetic core through at least one of a notch and a through hole provided in the second common magnetic yoke; and wherein a thickness of the first common magnetic yoke is 60–90% of a thickness of the second common magnetic yoke.

* * * * *